US012398013B2

(12) United States Patent
Kishimoto et al.

(10) Patent No.: US 12,398,013 B2
(45) Date of Patent: Aug. 26, 2025

(54) SHEET POST-PROCESSING DEVICE

(71) Applicant: KYOCERA Document Solutions Inc., Osaka (JP)

(72) Inventors: Tadahisa Kishimoto, Osaka (JP); Koji Murata, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 97 days.

(21) Appl. No.: 18/585,312

(22) Filed: Feb. 23, 2024

(65) Prior Publication Data

US 2024/0286862 A1 Aug. 29, 2024

(30) Foreign Application Priority Data

Feb. 27, 2023 (JP) ..... 2023-028738

(51) Int. Cl.
*B65H 31/36* (2006.01)
*B65H 29/52* (2006.01)
*B65H 31/26* (2006.01)

(52) U.S. Cl.
CPC ..... *B65H 31/36* (2013.01); *B65H 29/52* (2013.01); *B65H 31/26* (2013.01); *B65H 2801/27* (2013.01)

(58) Field of Classification Search
CPC ..... B65H 29/52; B65H 31/36; B65H 31/26
See application file for complete search history.

(56) References Cited

U.S. PATENT DOCUMENTS

| | | | | |
|---|---|---|---|---|
| 9,296,224 | B2 * | 3/2016 | Kodama | B65H 31/26 |
| 9,718,284 | B2 * | 8/2017 | Hirose | B65H 31/24 |
| 9,878,868 | B2 * | 1/2018 | Kobayashi | B65H 31/02 |
| 12,134,538 | B2 * | 11/2024 | Kishimoto | B65H 43/08 |
| 2017/0066616 | A1 * | 3/2017 | Endo | B65H 45/18 |
| 2017/0248888 | A1 * | 8/2017 | Izumichi | B65H 31/02 |
| 2019/0144221 | A1 * | 5/2019 | Lo | B65H 31/02 271/30.1 |

FOREIGN PATENT DOCUMENTS

JP 2002-255431 A 9/2002

* cited by examiner

*Primary Examiner* — Patrick Cicchino
(74) *Attorney, Agent, or Firm* — Stein IP LLC

(57) ABSTRACT

A sheet post-processing device includes a discharge port, a discharge tray, a first sheet pressing member, a second sheet pressing member, and a holding member. The holding member has a first holding portion that holds the first sheet pressing member, and a second holding portion that holds the second sheet pressing member. The first holding portion selectively holds the first sheet pressing member at a first pressing position for pressing a sheet and a first retreat position retreated to above a discharge route. The second holding portion selectively holds the second sheet pressing member at a second pressing position for pressing the sheet and a second retreat position retreated to above the discharge route.

7 Claims, 11 Drawing Sheets

SHEET POST-PROCESSING DEVICE

INCORPORATION BY REFERENCE

This application is based on and claims the benefit of priority from Japanese Patent Application No. 2023-028738 filed on Feb. 27, 2023, the contents of which are hereby incorporated by reference.

BACKGROUND

The present disclosure relates to a sheet post-processing device that performs post-processing with respect to a sheet having had an image formed thereon by an image forming apparatus.

A known sheet post-processing device performs folding processing of forming a fold in a sheet having had an image formed thereon by an image forming apparatus such as a copier, a printer, or the like. In a case where sheets subjected to such folding processing are discharged to be stacked on a discharge tray, the folded parts of the sheets make the stack of the sheets partly thick, making it difficult to stack a large number of such sheets in an orderly manner. Measures have conventionally been taken to deal with this inconvenience.

SUMMARY

According to one aspect of the present disclosure, a sheet post-processing device includes a discharge port, a discharge tray, a first sheet pressing member, a second sheet pressing member, and a holding member. The discharge port has a pair of discharge rollers that discharge a sheet. On the discharge tray, the sheet discharged through the discharge port is stacked. The first sheet pressing member is attached above the pair of discharge rollers, and presses an upstream part, in a sheet discharge direction, of the sheet stacked on the discharge tray. The second sheet pressing member is attached above the pair of discharge rollers, and presses a downstream part, in the sheet discharge direction, of the sheet stacked on the tray. The holding member holds the first sheet pressing member and the second sheet pressing member. The holding member has a first holding portion and a second holding portion. The first holding portion holds the first sheet pressing member such that the first sheet pressing member is swingable to a first pressing position, at which the first sheet pressing member extends, intersecting a discharge route of the sheet, downward from above the pair of discharge rollers toward the discharge tray to press the sheet, and to a first retreat position retreated to above the discharge route of the sheet. The second holding portion holds the second sheet pressing member such that the second sheet pressing member is swingable to a second pressing position, at which the second sheet pressing member extends, intersecting the discharge route of the sheet, downward from above the pair of discharge rollers toward the discharge tray to press the sheet, and to a second retreat position retreated to above the discharge route of the sheet. The first holding portion selectively holds the first sheet pressing member at the first pressing position and the first retreat position. The second holding portion selectively holds the second sheet pressing member at the second pressing position and the second retreat position.

DETAILED DESCRIPTION

An embodiment of the present disclosure will be described below with reference to the accompanying drawings. It should be understood, however, that the present disclosure is not limited to what is specifically described below.

Figure 1:
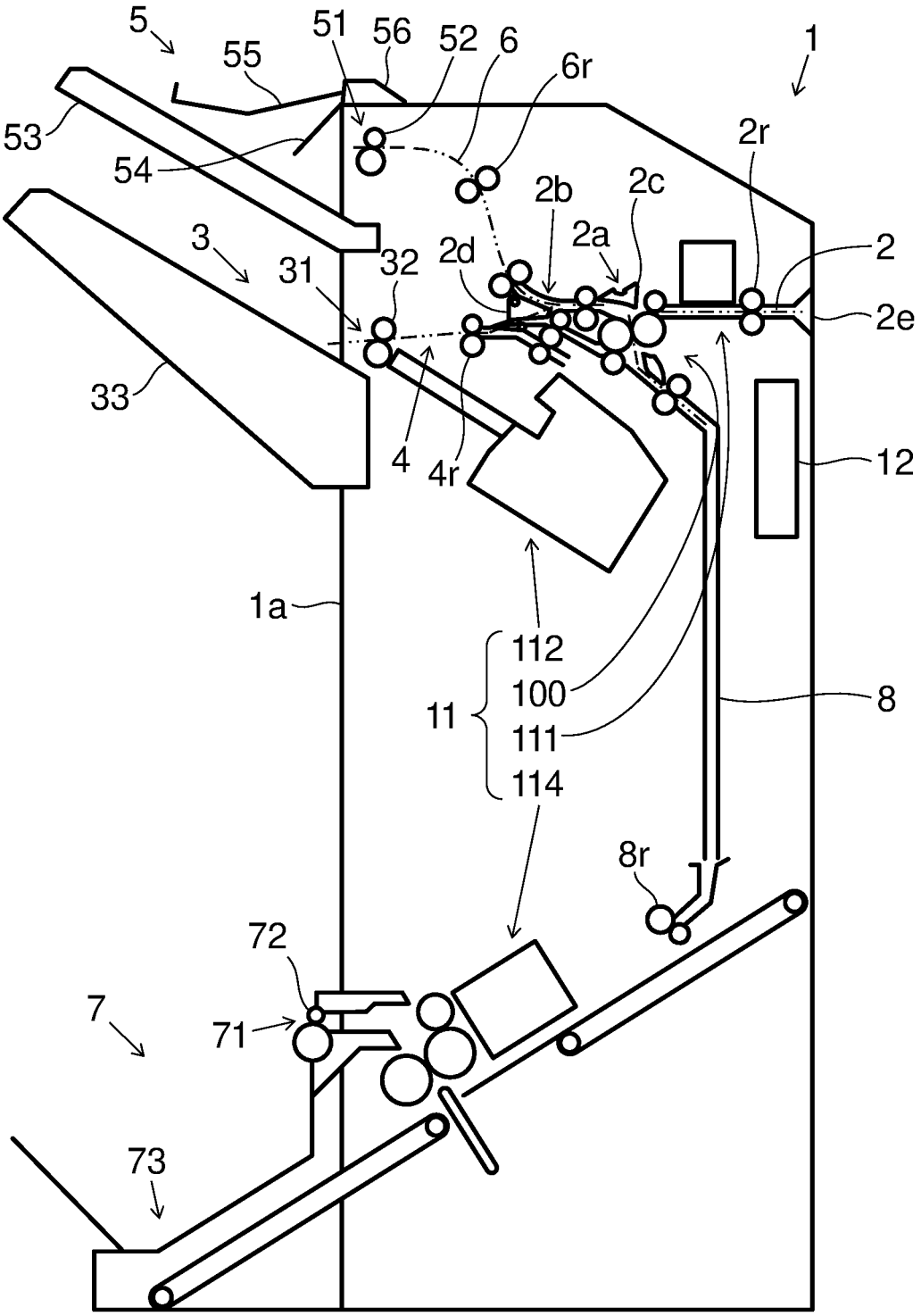
FIG. 1 is a schematic sectional front view of a sheet post-processing device according to an embodiment of the present disclosure.

FIG. 1 is a schematic sectional front view of a sheet post-processing device 1 according to an embodiment. The sheet post-processing device 1 is coupled to a side surface of an image forming apparatus (unillustrated), for example, so as to be attachable and detachable. The sheet post-processing device 1 performs post-processing with respect to a sheet having had an image formed (printed) thereon by the image forming apparatus.

As shown in FIG. 1, the sheet post-processing device 1 includes a sheet introduction path 2, a first sheet discharge portion 3, a first sheet discharge path 4, a second sheet discharge portion 5, a second sheet discharge path 6, a third sheet discharge portion 7, a third sheet discharge path 8, a post-processing portion 11, and a post-processing control portion 12.

The sheet introduction path 2 has a sheet introduction port 2*e*. The sheet introduction port 2*e* is provided, and opened, in a side surface of the sheet post-processing device 1, the side surface facing the image forming apparatus (unillustrated). A sheet conveyed from the image forming apparatus toward the sheet post-processing device 1 passes through the sheet introduction port 2*e* and the sheet introduction path 2 to be introduced into the sheet post-processing device 1.

The sheet introduction path 2 substantially horizontally extends from the sheet introduction port 2*e* to a sheet folding portion 100, which will be described later, in a direction (a leftward direction in FIG. 1) away from the image forming apparatus. In this description, a direction from the sheet introduction port 2*e* toward an inside of the sheet post-processing device 1 is referred to as a sheet conveyance direction along the sheet introduction path 2. The sheet introduction port 2*e* is located at an upstream end of the sheet introduction path 2 in the sheet conveyance direction. In the sheet introduction path 2, pairs of feed rollers 2*r* are disposed.

The pairs of feed rollers 2*r* convey, on the sheet introduction path 2, a sheet introduced through the sheet introduction port 2*e* into the sheet post-processing device 1, toward a downstream side in the sheet conveyance direction.

The sheet introduction path 2 has a first branching portion 2*a* and a second branching portion 2*b*. The first branching portion 2*a* is located upstream of the second branching portion 2*b* with respect to the sheet conveyance direction along the sheet introduction path 2. The second branching portion 2*b* is located at a downstream end part of the sheet introduction path 2 in the sheet conveyance direction.

At the first branching portion 2*a*, a first switching guide 2*c* is disposed. The first switching guide 2*c* switches a conveyance direction of a sheet conveyed on the sheet introduction path 2 from a side of the sheet introduction port 2*e* toward the downstream side in the sheet conveyance direction between a direction leading to the first sheet discharge portion 3 and the second sheet discharge portion 5 and a direction leading to the third sheet discharge portion 7.

At the second branching portion 2*b*, a second switching guide 2*d* is disposed. The second switching guide 2*d* switches the conveyance direction of the sheet conveyed on the sheet introduction path 2 from the side of the sheet introduction port 2*e* toward the downstream side in the sheet conveyance direction between a direction leading to the first sheet discharge portion 3 and a direction leading to the second sheet discharge portion 5.

The first sheet discharge portion 3 is provided on a side surface 1*a* of the sheet post-processing device 1, the side surface 1*a* being located opposite the side surface of the sheet post-processing device 1 that faces the image forming apparatus. The first sheet discharge portion 3 has a first discharge port 31, a pair of first discharge rollers 32, and a first discharge tray 33.

The first discharge port 31 is located at a downstream end of the first sheet discharge path 4 in the sheet conveyance direction. The pair of first discharge rollers 32 are disposed at the first discharge port 31. The first discharge tray 33 is located downstream of the first discharge port 31 in the sheet conveyance direction. A sheet having been conveyed along the first sheet discharge path 4 to reach the first discharge port 31 is discharged, by the pair of first discharge rollers 32, through the first discharge port 31 onto the first discharge tray 33. The first discharge tray 33 is one of final discharge destinations of sheets subjected to the post-processing performed by the sheet post-processing device 1.

The first sheet discharge path 4 is continuous with the downstream end of the sheet introduction path 2 in the sheet conveyance direction, and substantially horizontally extends to the first sheet discharge portion 3 in the direction (the leftward direction in FIG. 1) away from the image forming apparatus. In this description, a direction (the leftward direction in FIG. 1) from the inside of the sheet post-processing device 1 toward the first discharge portion 3 is referred to as a sheet conveyance direction along the first sheet discharge path 4. In the first sheet discharge path 4, pairs of feed rollers 4*r* are disposed. The pairs of feed rollers 4*r* convey a sheet having passed through the sheet introduction path 2 to reach the second branching portion 2 toward a downstream side on the first sheet discharge path 4 in the sheet conveyance direction, that is, toward the first sheet discharge portion 3.

The second sheet discharge portion 5 is provided on the side surface 1*a* of the sheet post-processing device 1 located opposite the side surface thereof facing the image forming apparatus, above the first sheet discharge portion 3. The second sheet discharge portion 5 has a second discharge port (a discharge port) 51, a pair of second discharge rollers (a pair of discharge rollers) 52, and a second discharge tray (a discharge tray) 53.

The second discharge port 51 is located at a downstream end of the second sheet discharge path 6 in the sheet conveyance direction. The pair of second discharge rollers 52 are disposed at the second discharge port 51. The second discharge tray 53 is located downstream of the second discharge port 51 in the sheet conveyance direction. A sheet having been conveyed through the second sheet discharge path 6 to reach the second discharge port 51 is discharged, by the pair of second discharge rollers 52, through the second discharge port 51 onto the second discharge tray 53. The second discharge tray 53 is one of the final discharge destinations of sheets subjected to the post-processing performed by the sheet post-processing device 1.

The second sheet discharge path 6 branches off from the second branching portion 2 located at a downstream part of the sheet introduction path 2 in the sheet conveyance direction, and the second sheet discharge path 6 extends not only laterally in the direction (the leftward direction in FIG. 1) away from the image forming apparatus but also in an upward direction to the second sheet discharge portion 5. In this description, a direction (an upper-leftward direction in FIG. 1) from the second branching portion 2*b* toward the second sheet discharge portion 5 is referred to as a sheet conveyance direction along the second sheet discharge path 6. In the second sheet discharge path 6, pairs of feed rollers 6*r* are disposed. The pairs of feed rollers 6*r* convey a sheet having passed through the sheet introduction path 2 to reach the second branching portion 2 toward a downstream side on the second sheet discharge path 6 in the sheet conveyance direction, that is, toward the second sheet discharge portion 5.

The third sheet discharge portion 7 is provided on the side surface 1*a* of the sheet post-processing device 1 located opposite the side surface thereof facing the image forming apparatus, below the first sheet discharge portion 3. In other words, the third sheet discharge portion 7 is disposed near a bottom part of the sheet post-processing device 1. The third sheet discharge portion 7 has a third discharge port 71, a pair of third discharge rollers 72, and a third discharge tray 73.

The third discharge port 71 is located at a downstream end of the third sheet discharge path 8 in the sheet conveyance direction. The pair of third discharge rollers 72 are disposed at the third discharge port 71. The third discharge tray 73 is located downstream of the third discharge port 71 in the sheet conveyance direction. A sheet having been conveyed through the third sheet discharge path 8 to reach the third discharge port 71 is discharged, by the pair of third discharge rollers 72, through the third discharge port 71 onto the third discharge tray 73. The third discharge tray 73 is one of the final discharge destinations of sheets subjected to the post-processing performed by the sheet post-processing device 1.

The third sheet discharge path 8 branches off from the first branching portion 2*a* located at the downstream part of the sheet introduction path 2 in the sheet conveyance direction, and extends in a downward direction to the third sheet discharge portion 7. In this description, a direction from the first branching portion 2*a* toward the third sheet discharge portion 7 is referred to as a sheet conveyance direction along the third sheet discharge path 8. In the third sheet discharge path 8, pairs of feed rollers 8*r* are disposed. The pairs of feed rollers 8*r* convey a sheet having passed through the sheet introduction path 2 to reach the first branching portion 1 toward a downstream side on the third sheet discharge path 8 in the sheet conveyance direction, that is, toward the third sheet discharge portion 7.

The post-processing portion 11 performs predetermined post-processing with respect to a sheet having been subjected to image formation performed by the image forming apparatus and introduced into the sheet post-processing device 1. The post-processing portion 11 includes a punching portion 111, a stapling portion 112, a sheet folding portion 100, and a book-binding portion 114.

The punching portion 111 is disposed in the sheet introduction path 2, closely downstream of the sheet introduction port 2*e*. The punching portion 111 is capable of performing punching processing with respect to a sheet conveyed on the sheet introduction path 2, thereby to form a punch hole in the sheet.

The stapling portion 112 is disposed below the first sheet discharge path 4, in the vicinity of the first sheet discharge portion 3. The stapling portion 112 is capable of performing stapling processing (binding processing) with respect to a bundle of sheets formed by stacking together a plurality of sheets, thereby to bind the bundle of sheets.

The sheet folding portion 100 is disposed, with respect to the sheet conveyance direction along the sheet introduction path 2, downstream of the punching portion 111, upstream of the stapling portion 112. The sheet folding portion 100 is capable of performing folding processing with respect to a single sheet, thereby to make a fold in the single sheet.

Figure 2A:
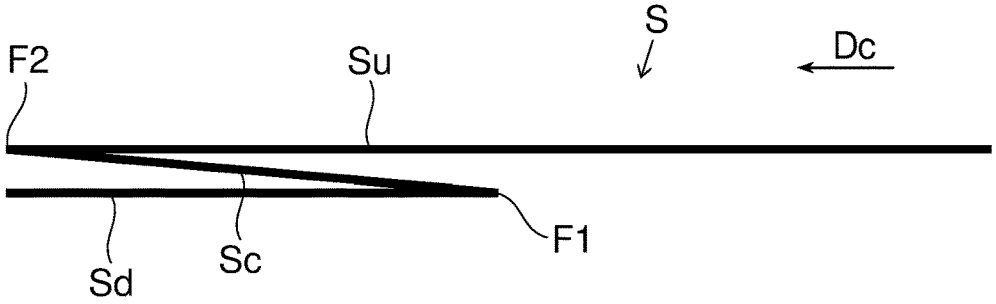
FIG. 2A is a schematic front view of a Z-folded sheet.
Figure 2B:
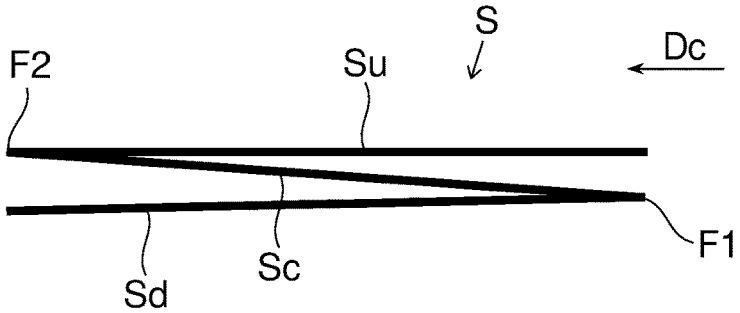
FIG. 2B is a schematic front view of an outward triple-folded sheet.
Figure 2C:
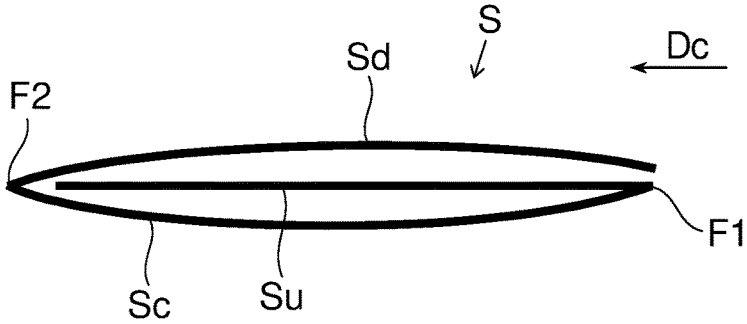
FIG. 2C is a schematic front view of an inward triple-folded sheet.

The sheet folding portion 100 is capable of performing, with respect to a single sheet, processing such as double-folding, Z-folding, outward triple-folding, inward triple-folding, quadruple-folding, etc. FIGS. 2A, 2B, and 2C are schematic front views of a Z-folded sheet S, an outward triple-folded sheet S, and an inward triple-folded sheet S, respectively.

Z-folding is a manner of folding in which, as shown in FIG. 2A, for example, a downstream part of a sheet S with respect to the sheet conveyance direction Dc along the sheet introduction path 2 is formed into a Z-shape as seen from a sheet width direction (the depth direction of the plane of FIG. 2A) orthogonal to the sheet conveyance direction. In Z-folding, a downstream part Sd of the sheet S downstream of a first fold F1 in the sheet conveyance direction Dc and an upstream part Su of the sheet S upstream of a second fold F2 face each other in an up-down direction across a middle part Sc of the sheet S between the two folds. In the sheet conveyance direction Dc, the downstream part Sd and the middle part Sc of the sheet S are approximately equal in length, but are shorter than the upstream part Su in length.

Figure 3:
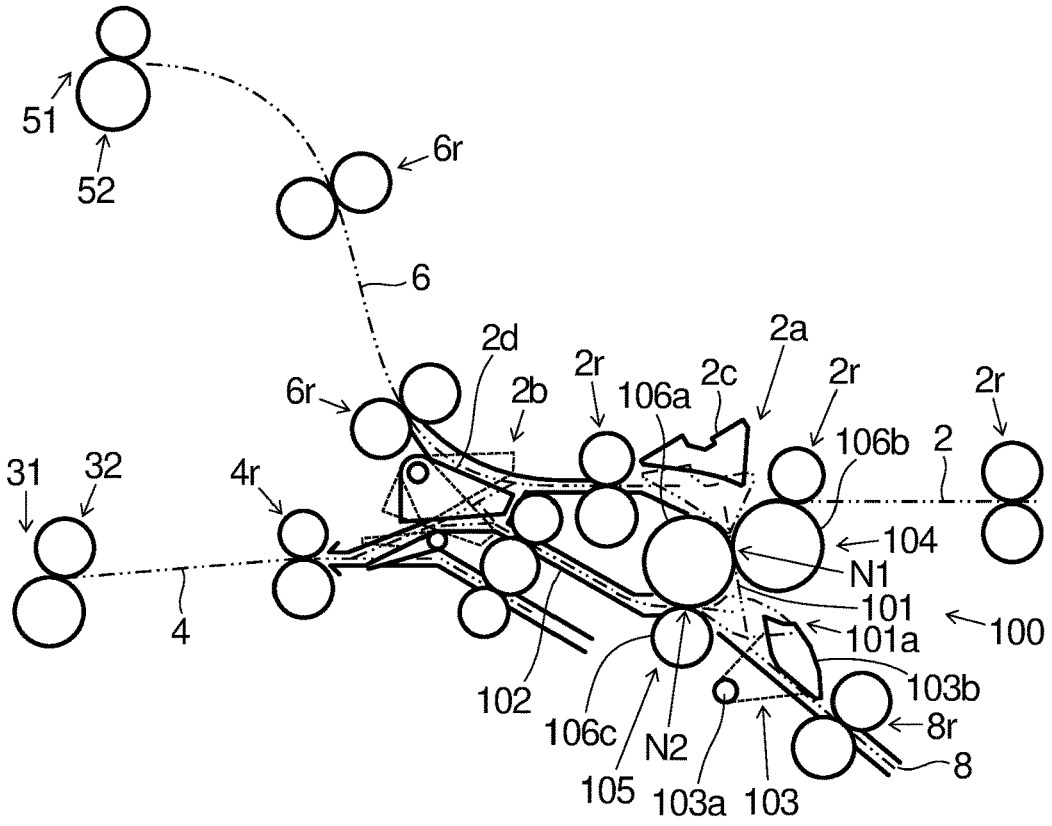
FIG. 3 is a partial sectional front view showing a sheet folding portion of the sheet post-processing device and its vicinity shown in FIG. 1.

Outward triple-folding is a manner of folding in which, as shown in FIG. 3, for example, an entire sheet S is formed into a Z-shape as seen from the sheet width direction (the depth direction of the plane of FIG. 2B). In outward triple folding, a downstream part Sd of the sheet S downstream of a first fold F1 in the sheet conveyance direction Dc and an upstream part Su of the sheet S upstream of a second fold F2 face each other in the up-down direction across a middle part Sc of the sheet S between the two folds. In the sheet conveyance direction Dc, the downstream part Sd, the middle part Sc, and the upstream part Su of the sheet S are approximately equal in length.

In inward triple-folding, as shown in FIG. 2C, for example, an upstream part Su of a sheet S upstream of a first fold F1 in the sheet conveyance direction Dc and a downstream part Sd of the sheet S downstream of a second fold F2 face each other in the up-down direction and make surface contact with each other at one side of (in FIG. 2C, above) the plane of a middle part Sc of the sheet S between the two folds.

In this description, a sheet having been subjected to the folding processing may be referred to as a "folded sheet."

The book-binding portion 114 is disposed in a downstream part of the third sheet discharge path 8 in the sheet conveyance direction, in the vicinity of the third sheet discharge portion 7. The book-binding portion 114 is capable of performing, with respect to a bundle of sheets formed by stacking a plurality of sheets, middle-folding processing and middle-binding processing in which the book-binding portion 114 folds and binds the bundle of sheets substantially at its middle, thereby to form a booklet.

The post-processing control portion 12 includes a CPU, an image processor, a storage, and other electronic circuits and electronic components (of which none is shown). The post-processing control portion 12 is communicably connected to a main control portion of the image forming apparatus (not shown). The post-processing control portion 12 receives instructions from the main control portion, and by means of the CPU and based on a control program and control data stored in the storage, controls operations of various components provided in the sheet post-processing device 1 so as to perform processing related to functions of the sheet conveyance device 1. The sheet introduction path 2, the first sheet discharge portion 3, the first sheet discharge path 4, the second sheet discharge portion 5, the second sheet discharge path 6, the third sheet discharge portion 7, the third sheet discharge path 8, and the post-processing portion 11 individually receive instructions from the post-processing control portion 12 to cooperate so as to perform post-processing on sheets. The functions of the post-processing control portion 12 may be assumed by the main control portion of the image forming apparatus.

Next, a configuration of the sheet folding portion 100 will be described with reference to FIG. 3. FIG. 3 is a partial sectional front view showing the sheet folding portion 100 of the sheet post-processing device 1 and its vicinity shown in FIG. 1. The sheet folding portion 100 includes a first sheet conveyance path 101, a second sheet conveyance path 102, and a folding blade 103.

The first sheet conveyance path 101 is configured as an upstream part of the third sheet discharge path 8 in the sheet conveyance direction. That is, the first sheet conveyance path 101 branches off from the first branching portion 2*a* which is on the sheet introduction path 2, and extends in a direction toward where the third sheet discharge portion 7 is located, in a downward direction in FIG. 3. Along the first sheet conveyance path 101, a sheet is conveyed.

The second sheet conveyance path 102 branches off from a folding branching portion 101*a* which is on the first sheet conveyance path 101, and extends in a direction for intersecting the first sheet conveyance path 101. The second sheet conveyance path 102 extends from the folding branching portion 101*a* toward a side-face-1*a* side part of the sheet post-processing device 1 where the first sheet discharge path 4 is provided, in a leftward direction in FIG. 3. Along the second sheet conveyance path 102, a sheet is conveyed. A downstream end of the second sheet conveyance path 102 in the sheet conveyance direction merges with the second branching portion 2*b*.

The folding blade 103 is disposed in the vicinity of the folding branching portion 101*a* which is on the first sheet conveyance path 101. The folding blade 103 has a swing support shaft 103*a* and a blade portion 103*b*. The swing support shaft 103*a* and the blade portion 103*b* are located, as seen from the sheet width direction (the depth direction of the plane of FIG. 3) orthogonal to the sheet conveyance direction, at positions opposite each other across a sheet conveyance region of the first sheet conveyance path 101, the sheet conveyance region being downstream of the folding branching portion 101*a*.

The swing support shaft 103*a* extends in a direction parallel to the sheet width direction. The folding blade 103 swings about an axis of the swing support shaft 103*a* clockwise or counterclockwise in FIG. 3. To be more specific, the folding blade 103 is swingable so as to be positioned at a first position (see FIG. 3) for guiding a sheet conveyed on the first sheet conveyance path 101 to a downstream part of the first sheet conveyance path 101 in the sheet conveyance direction and a second position (see FIG. 6) for guiding a sheet conveyed on the first sheet conveyance path 101 to the second sheet conveyance path 102.

Further, the sheet folding portion 100 includes a pair of first conveyance rollers 104 and a pair of second conveyance rollers 105.

The pair of first conveyance rollers 104 are disposed, with respect to the sheet conveyance direction along the first sheet conveyance path 101, at a downstream part of the first branching portion 2*a*. The pair of first conveyance rollers 104 convey a sheet on the first sheet conveyance path 101 in a direction away from the first branching portion 2*a*. The pair of first conveyance rollers 104 are constituted of a first roller 106*a* and a second roller 106*b*. The first roller 106*a* and the second roller 106*b* are disposed opposite each other across the sheet conveyance region of the first sheet conveyance path 101, and thereby form a first nip portion N1.

The first switching guide 2*c* is disposed opposite the first nip portion N1 across a sheet conveyance region of the sheet introduction path 2. The first switching guide 2*c* is reciprocatable in directions toward and away from the first nip portion N1.

The first switching guide 2*c* approaches the first nip portion N1 before a sheet conveyed on the sheet introduction path 2 reaches the first branching portion 2*a*, thereby to guide the sheet to the first nip portion N1, thus switching the conveyance direction of the sheet to direct the sheet into the first sheet conveyance path 101 (the third sheet discharge path 8). Further, the first switching guide 2*c* can press such part of a sheet conveyed on the sheet introduction path 2 as has stopped over the first branching portion 2*a* and corresponds to a fold toward the first nip portion N1, and thus can also be used as a folding blade that performs folding processing on the sheet.

The second roller 106*b* is also used as one of the rollers that constitute one of the pairs of feed rollers 2*r* on the sheet introduction path 2.

The pair of second conveyance rollers 105 are disposed in a downstream part of the folding branching portion 101*a* with respect to the sheet conveyance direction along the second sheet conveyance path 102. The pair of second conveyance rollers 105 convey a sheet on the second sheet conveyance path 102 in a direction away from the folding branching portion 101*a*. The pair of second conveyance rollers 105 are constituted of the first roller 106*a* and a third roller 106*c*. The first roller 106*a* and the third roller 106*c* are disposed opposite each other across a sheet conveyance region of the second sheet conveyance path 102, and thereby form a second nip portion N2.

The folding blade 103 is disposed opposite the second nip portion N2 across the sheet conveyance region of the first sheet conveyance path 101. The folding blade 103 is reciprocatable in directions toward and away from the second nip portion N2.

The folding blade 103 approaches the second nip portion N2 before a sheet conveyed on the first sheet conveyance path 101 reaches the folding branching portion 101*a*, thereby to guide the sheet to the second nip portion N2, thus switching the conveyance direction of the sheet to direct the sheet into the second sheet conveyance path 102. Further, the folding blade 103 presses, toward the second nip portion N2, such part of a sheet conveyed on the first sheet conveyance path 101 as has stopped over the folding branching portion 101*a* and corresponds to a fold, and thereby performs folding processing on the sheet to form a fold therein.

Figure 4:
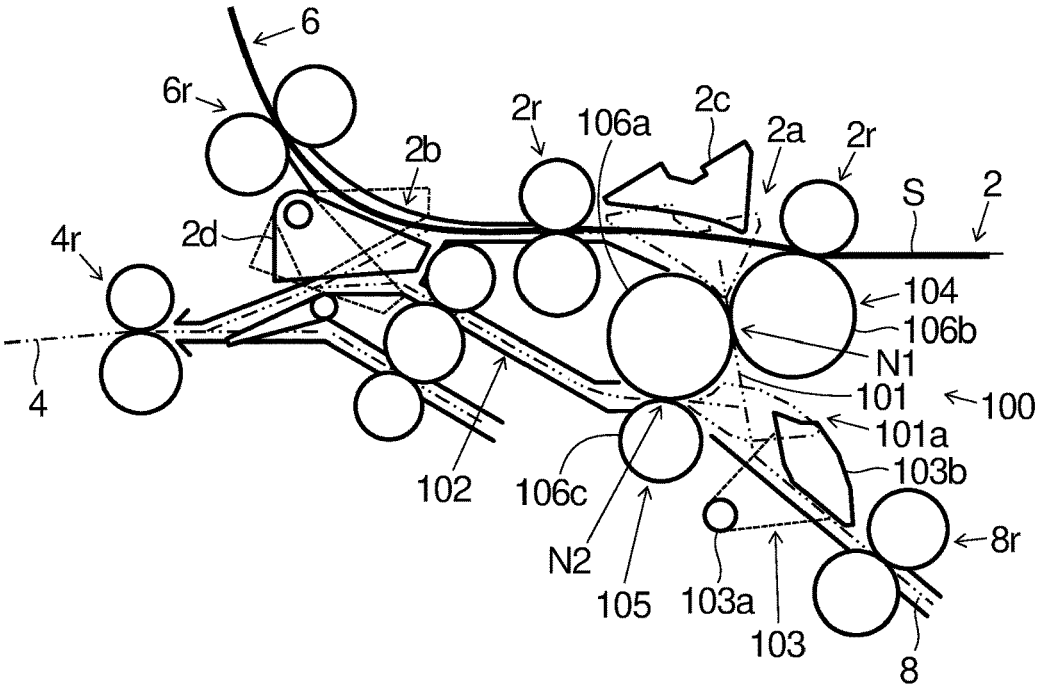
FIG. 4 is a sectional front view showing the sheet folding portion and its vicinity shown in FIG. 3, illustrating a first stage in the course of inward triple-folding processing for a sheet.
Figure 5:
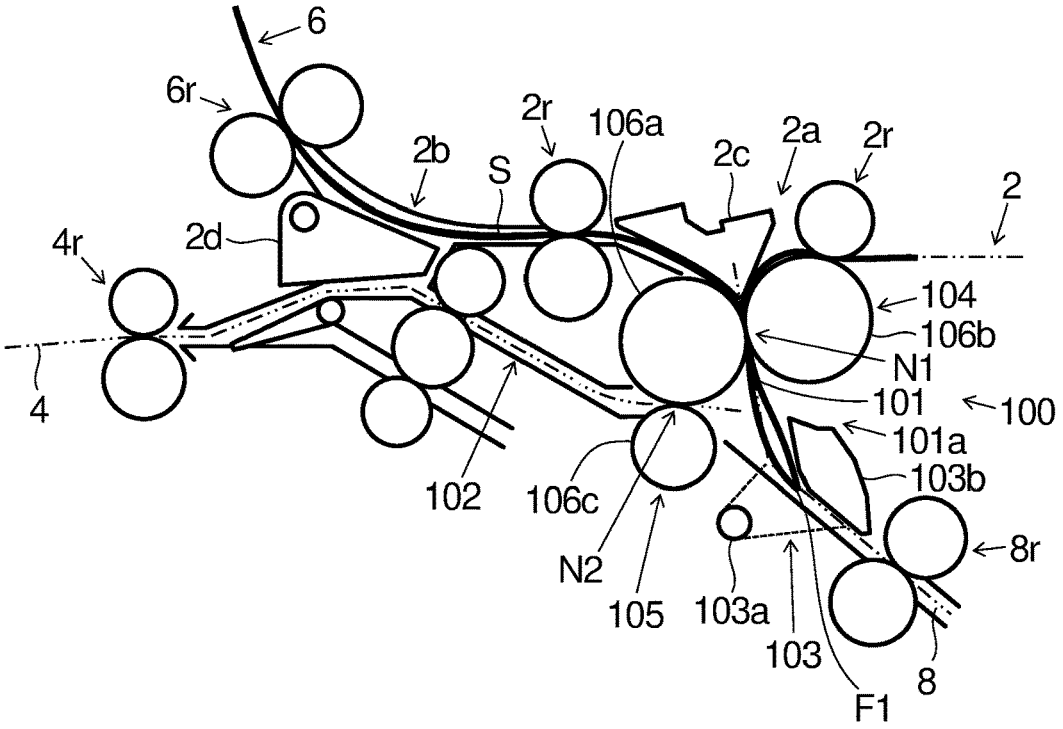
FIG. 5 is a sectional front view showing the sheet folding portion and its vicinity shown in FIG. 3, illustrating a second stage in the course of the inward triple-folding processing for a sheet.
Figure 6:
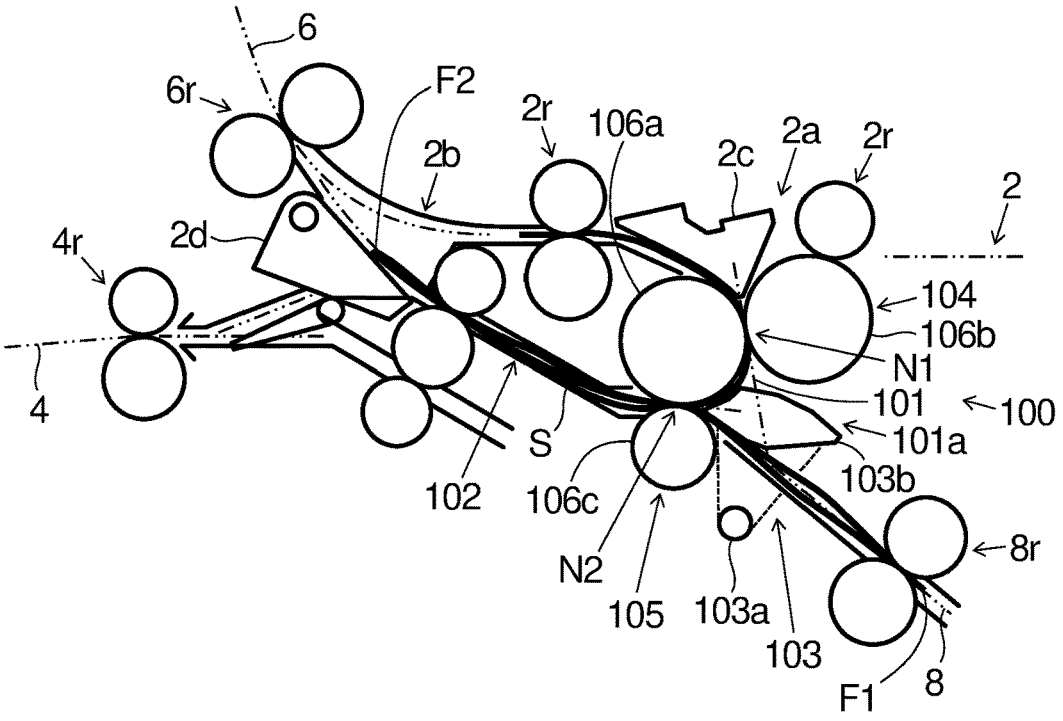
FIG. 6 is a sectional front view showing the sheet folding portion and its vicinity shown in FIG. 3, illustrating a third stage in the course of the inward triple-folding processing for a sheet.

Next, an operation of the sheet folding portion 100 will be described with reference to FIGS. 4, 5, and 6. FIGS. 4, 5, and 6 are sectional front views showing the sheet folding portion 100 and its vicinity shown in FIG. 3, respectively illustrating a first stage, a second stage, and a third stage in the course of inward triple-folding processing for a sheet S. The following description of the operation of the sheet folding portion 100 deals with, as an example, folding processing for inward triple folding as shown in FIG. 2C.

As shown in FIG. 4, when a sheet S is introduced through the sheet introduction port 2*e* (see FIG. 1) into the sheet introduction path 2, a downstream part of the sheet S in the sheet conveyance direction is guided via the second branching portion 2*b* to the second sheet discharge path 6. The second switching guide 2*d* of the second branching portion 2*b* switches the conveyance direction of the sheet S conveyed on the sheet introduction path 2 from the sheet introduction port 2*e* so as to guide the sheet S to the second sheet discharge path 6.

The first switching guide 2*c* of the first branching portion 2*a* is retreated from the sheet introduction path 2 in a direction away from the first nip portion N1, that is, to a position above the sheet introduction path 2 in FIG. 4.

Subsequently, when part of the sheet S corresponding to a first fold F1 (see FIG. 2C) reaches the first branching portion 2*a*, the pairs of feed rollers 2*r* in the sheet introduction path 2 and the pairs of feed rollers 6*r* in the second sheet discharge path 6 are caused to stop rotating, so that the conveyance of the sheet S is stopped. Then, such one of the pairs of feed rollers 2*r* as is disposed, in the sheet introduction path 2, downstream of the first branching portion 2*a* (to the left of the first branching portion 2*a* in FIG. 4) in the sheet conveyance direction, and the pairs of the feed rollers 6*r* in the second sheet discharge path 6, are caused to rotate reversely. Thereby, such part of the sheet S as is located downstream of the first branching portion 2*a* in the sheet conveyance direction moves upstream (rightward in FIG. 4), so that the sheet S is caused to sag at the first branching portion 2*a*.

Subsequently, the first switching guide 2*c* is moved in a direction toward the first nip portion N1 of the pair of first conveyance rollers 104, and makes contact with the sheet S. By making contact with the sheet S, the first switching guide 2*c* guides the sagging part of the sheet S to the first nip portion N1. Then, passing through the first nip portion N1, the sheet S has the first fold F1 formed therein as shown in FIG. 5.

The timing for forming the first fold F1 in the sheet S is determined in accordance with the timing with which a sheet sensor (unillustrated) detects, in the first sheet introduction path 2, a downstream end of the sheet S in the sheet conveyance direction, a length of the sheet S in the sheet conveyance direction, and a conveyance speed of the sheet S. This also applies to the timing for forming the second fold F2, which will be described later.

The folding blade 103 at the folding branching portion 101*a* is retreated from the first sheet conveyance path 101 in a direction away from the second nip portion N2, that is, to the right of the first sheet conveyance path 101 in FIG. 5.

After passing through the first nip portion N1, the sheet S is conveyed, starting with its part where the first fold F1 is formed, and with its two regions that extend along the sheet conveyance direction overlapped with each other, along the first sheet conveyance path 101 in a direction away from the first branching portion 2*a*. After passing through the first sheet conveyance path 101, an upstream part of the sheet S in the conveyance direction temporarily enters the third sheet discharge path 8.

Subsequently, when the part of the sheet S corresponding to the second fold F2 (see FIG. 2C) reaches the folding branching portion 101*a*, the pairs of feed rollers 2*r* in the sheet introduction path 2, the pairs of feed rollers 6*r* in the second sheet discharge path 6, the pair of first conveyance rollers 104, and the pairs of feed rollers 8*r* in the third sheet discharge path 8 are caused to stop rotating, so that the conveyance of the sheet S is stopped. Then, the pairs of feed rollers 8*r* in the third sheet discharge path 8 are caused to rotate reversely. As a result, such part of the sheet S as is located downstream of the folding branching portion 101*a* in the sheet conveyance direction (as is below the folding branching portion 101*a* in FIG. 5) moves upstream (upward in FIG. 5), so that the sheet S is caused to sag at the folding branching portion 101*a*.

Subsequently, the folding blade 103 is moved in a direction toward the second nip portion N2 of the pair of second conveyance rollers 105 into contact with the sheet S. By contacting the sheet S, the folding blade 103 guides the sagging part of the sheet S to the second nip portion N2. Then, passing through the second nip portion N2, the sheet S has the second fold F2 formed therein as shown in FIG. 6.

After passing through the second nip portion N2, the sheet S is conveyed, starting with its part where the second fold F2 is formed, and with its three regions that extend along the sheet conveyance direction overlapped with each other, along the second sheet conveyance path 102 in a direction away from the pair of second conveyance rollers 105. After passing through the second sheet conveyance path 102, the sheet S enters the second sheet discharge path 6 via the second branching portion 2*b*, and is guided toward the second sheet discharge portion 5. Meanwhile, at the second branching portion 2*b*, the second switching guide 2*d* switches the conveyance direction of the sheet S having passed through the second sheet conveyance path 102 and reached the second branching portion 2*b* such that the sheet S is guided to the second sheet discharge path 6. The sheet S having been subjected to the folding processing is guided to the second sheet discharge path 6, to be discharged through the second discharge port 51 by the pair of second discharge rollers 52 to be stacked on the second discharge tray 53 (see FIG. 1).

Z-folding processing for Z-folding a sheet S (see FIG. 2A) and in outward triple-folding processing for outward triple-folding a sheet S (see FIG. 2B) can also be performed likewise, by changing the timing for forming the first fold F1 and for forming the second fold F2 in the sheet S, following the procedure described with reference to FIGS. 4, 5, and 6. Further, double-folding processing, quadruple-folding processing, etc. can also be performed likewise on a sheet S by changing the number of times of forming a fold and the timing for forming a fold.

Figure 7:
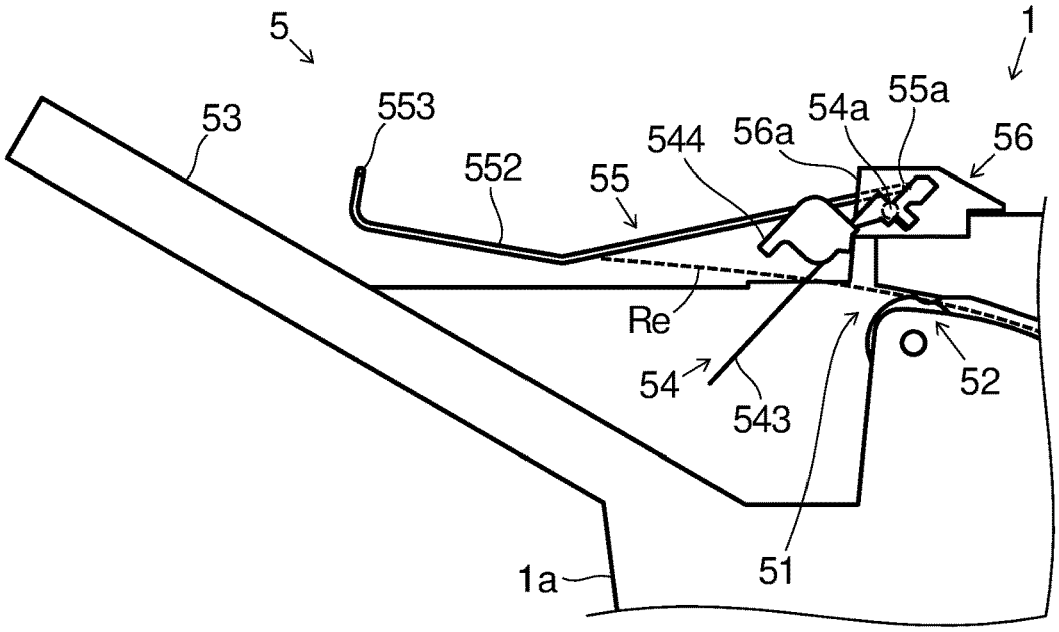
FIG. 7 is a partial sectional front view showing a second sheet discharge portion of the sheet post-processing device and its vicinity shown in FIG. 1.
Figure 8:
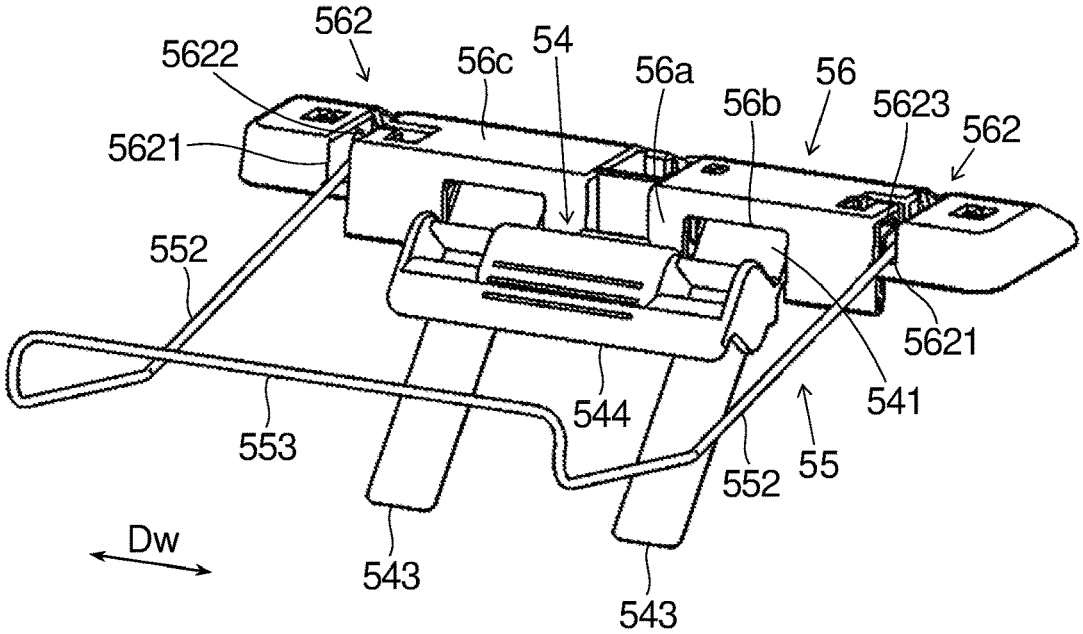
FIG. 8 is a perspective view showing a first sheet pressing member, a second sheet pressing member, and a holding member of the second sheet discharge portion shown in FIG. 7.
Figure 9:
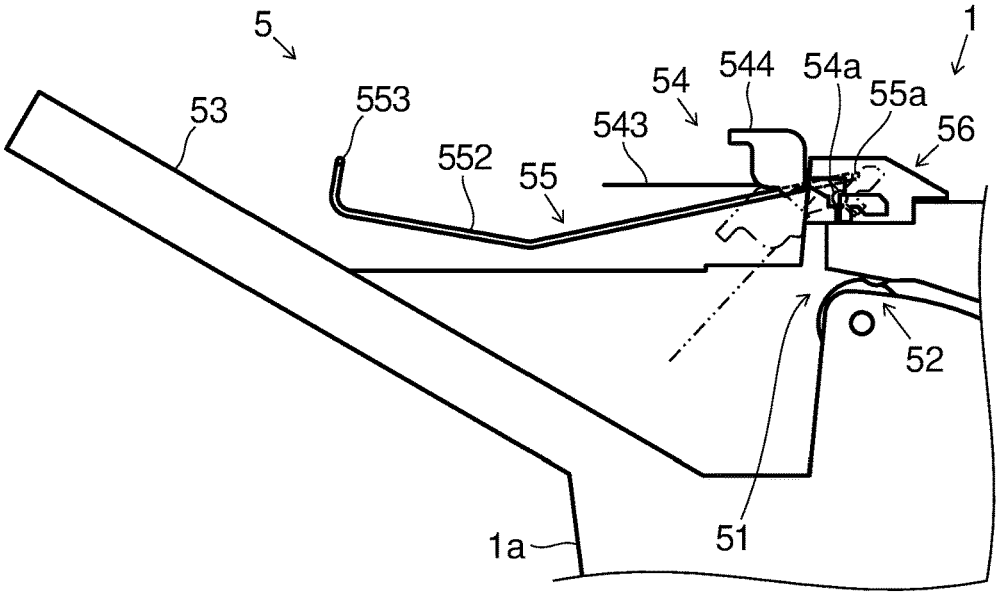
FIG. 9 is a partial sectional front view showing the second sheet discharge portion and its vicinity shown in FIG. 7, with the first sheet pressing member positioned at a retreat position.
Figure 10:
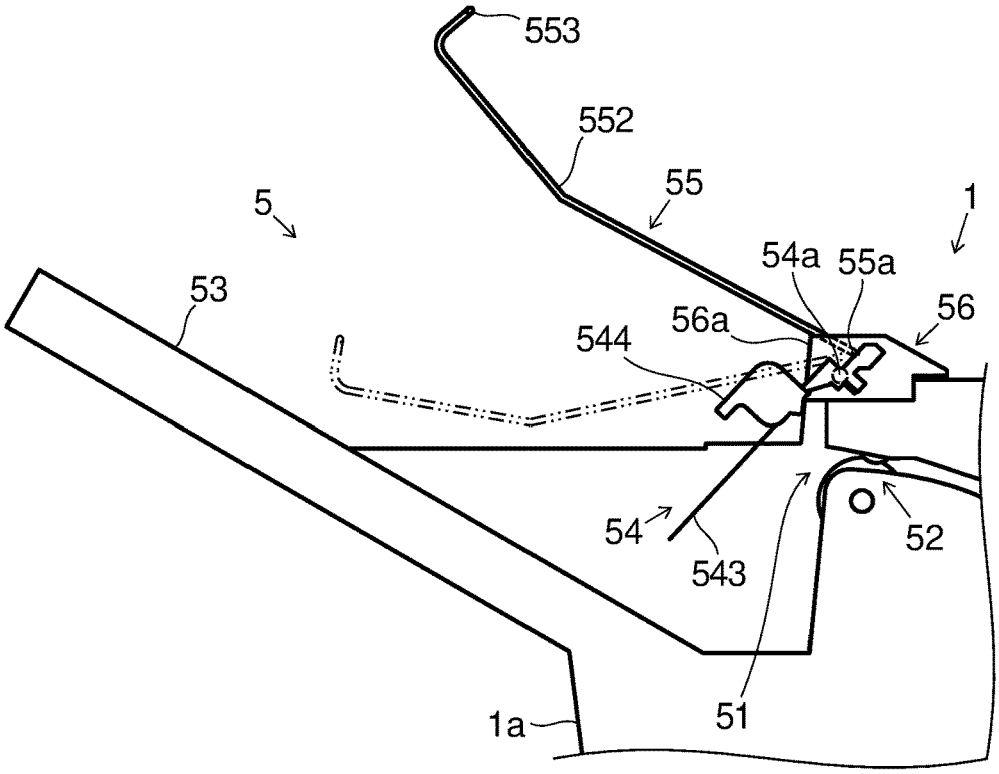
FIG. 10 is a partial sectional front view showing the second sheet discharge portion and its vicinity shown in FIG. 7, with the second sheet pressing member positioned at a retreat position.

Next, a configuration of the second sheet discharge portion 5 and its vicinity will be described with reference to FIGS. 7, 8. 9 and 10. FIG. 7 is a partial sectional front view showing the second sheet discharge portion 5 of the sheet post-processing device 1 and its vicinity shown in FIG. 1. FIG. 8 is a perspective view showing a first sheet pressing member 54, a second sheet pressing member 55 and a holding member 56 of the second sheet discharge portion 5 shown in FIG. 7. FIG. 9 and FIG. 10 are partial sectional front views showing the second discharge portion 5 and its vicinity shown in FIG. 7, with the first sheet pressing member 54 and the second sheet pressing member 55 each positioned at a retreat position. Note that, in FIG. 7, a discharge route Re for a sheet from the second discharge port 51 is depicted.

The second sheet discharge portion 5 has, in addition to the second discharge port 51, the pair of second discharge rollers 52, and the second discharge tray 53, the first sheet pressing member 54, the second sheet pressing member 55, and the holding member 56.

The second discharge tray 53 is connected to the side surface 1*a* of the sheet post-processing device 1, below the second discharge port 51, and extends downstream in a sheet discharge direction in which a sheet S is discharged through the second discharge port 51. The second discharge tray 53 has an upward inclination toward the downstream side in the sheet discharge direction, that is, away from the side surface 1*a* of the sheet post-processing device 1. With this configuration, a sheet discharged onto the second discharge tray 53 is gravitationally stacked so as to be close to the side surface 1*a* of the sheet post-processing device 1, which is on an upstream side in the sheet discharge direction.

The first sheet pressing member 54 is constituted of a sheet-shaped member, for example, having one end part (a base end part) thereof in the sheet discharge direction attached above the pair of second discharge rollers 52, and the other end (a leading end part) thereof in the sheet discharge direction extending parallel to the sheet discharge direction. The other end part (the leading end part) of the first sheet pressing member 54 in the sheet discharging direction extends to below the pair of second discharge rollers 52, so as to face the second discharge tray 53 across a predetermined space above the second discharge tray 53. The first sheet pressing member 54 contacts a downstream end of a sheet in the sheet discharge direction when the sheet is discharged through the second discharge port 51, and presses an upstream part, in the sheet discharge direction, of the sheet stacked on the second discharge tray 53.

The first sheet pressing member 54 is attached above the pair of second discharge rollers 52 so as to be swingable about a swing shaft 54*a* extending in the sheet width direction Dw. The first sheet pressing member 54 is swingable by being contacted by a sheet. That is, the first sheet pressing member 54 swings corresponding to the number of sheets stacked on the second discharge tray 53.

The second sheet pressing member 55 is constituted of, for example, a rod-shaped member having one end part (a base end part) thereof in the sheet discharge direction attached above the pair of second discharge rollers 52, and extending parallel to the sheet discharge direction. The other end part (a leading end part) of the second sheet pressing member 55 in the sheet discharge direction extends to below the pair of second discharge rollers 52, so as to, on a downstream side of the first sheet pressing member 54 in the sheet discharge direction, face the second discharge tray 53 across a predetermined space above the second discharge tray 53.

The second sheet pressing member 55 contacts a sheet discharged through the second discharge port 51, and presses a downstream part, in the sheet discharge direction, of the sheet stacked on the second discharge tray 53.

The second sheet pressing member 55 is attached above the pair of second discharge rollers 52 so as to be swingable about a swing shaft 55*a* extending in the sheet width direction Dw. The second sheet pressing member 55 is swingable by being contacted by a sheet. That is, the second sheet pressing member 55 swings corresponding to the number of sheets stacked on the second discharge tray 53.

In a case of discharging a folded sheet, having been subjected to the folding processing, into the second sheet discharge portion 5, as shown in FIG. 7, on a downstream side of the pair of second discharge rollers 52 in a discharge direction of the folded sheet, the first sheet pressing member 54 is positioned at a first pressing position, intersecting a discharge route Re of the folded sheet and extending downward from above the pair of second discharge rollers 52 toward the second discharge tray 53 so as to press the folded sheet. Further, in the case of discharging the folded sheet, having been subjected to the folding processing, into the second sheet discharge portion 5, as shown in FIG. 7, on the downstream side of the pair of second discharge rollers 52 in the discharge direction of the folded sheet, the second sheet pressing member 55 is positioned at a second pressing position, intersecting the discharge route Re of the folded sheet and extending downward from above the pair of second discharge rollers 52 toward the second discharge tray 53 so as to press the folded sheet.

On the other hand, in a case of discharging an unfolded sheet, not having been subjected to the folding processing, into the second sheet discharge portion 5, as shown in FIG. 9, on the downstream side of the pair of second discharge rollers 52 in the discharge direction of the folded sheet, the first sheet pressing member 54 is positioned at a first retreat position retreated to above the discharge route Re (see FIG. 7) of a folded sheet. Further, in the case of discharging the unfolded sheet, not having been subjected to the folding processing, into the second sheet discharge portion 5, as shown in FIG. 10, on the downstream side of the pair of second discharge rollers 52 in the discharge direction of the folded sheet, the second sheet pressing member 55 is positioned at a second retreat position retreated to above the discharge route Re (see FIG. 7) of a folded sheet.

As described above, the first sheet pressing member 54 is swingable to the first pressing position and to the first retreat position. The second sheet pressing member 55 is swingable to the second pressing position and to the second retreat position.

The holding member 56 is disposed on an upper surface of the sheet post-processing device 1. The holding member 56 is constituted of a hollow box having a substantially rectangular-parallelepiped shape extending in the sheet width direction Dw. The holding member 56 holds the first sheet pressing member 54 and the second sheet pressing member 55 so as to be swingable about the swing shafts 54*a* and 55*a*, respectively, which each extend in the sheet width direction Dw. A side surface 56*a* of the holding member 56 faces the same direction as a side surface 1*a* of the sheet post-processing device 1 does, the second discharge tray 53 being located on the side surface 1*a*, and the first sheet pressing member 54 and the second sheet pressing member 55 protrude toward the second discharge tray 53. The holding member 56 has a first holding portion 561 and a second holding portion 562.

The first holding portion 561 holds the first sheet pressing member 54. To be more specific, the first holding portion 561 selectively holds the first sheet pressing member 54 at the first pressing position and the first retreat position (see FIG. 9). Further, the second holding portion 562 holds the second sheet pressing member 55. To be more specific, the second holding portion 562 selectively holds the second sheet pressing member 55 at the second pressing position and the second retreat position (see FIG. 10). The selective positioning with respect to the first sheet pressing member 54 and the second sheet pressing member 55 is manually done by a user.

According to the above configuration, in a case where, for example, sheets with low stiffness (hardness, firmness) are to be discharged, the first sheet pressing member 54 and the second sheet pressing member 55 can be positioned at their respective retreat positions. Thereby, it becomes possible, regardless of the type of sheets, to have a large number of sheets stacked on the second discharge tray 53 in an orderly manner.

Next, detailed configurations of the first sheet pressing member 54, the second sheet pressing member 55, and the holding member 56 will be described.

Figure 11:
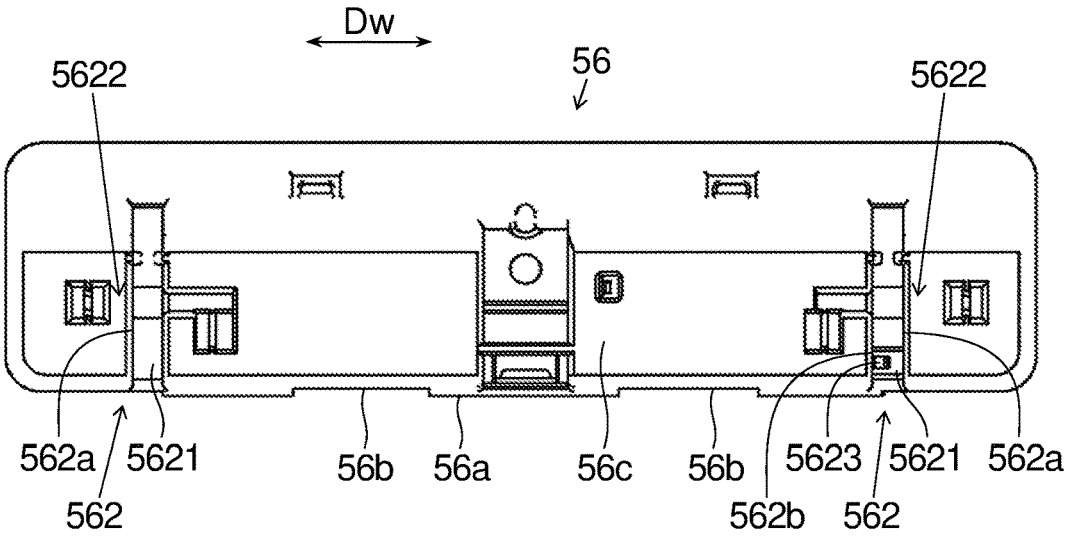
FIG. 11 is a top view of the holding member of the second sheet discharge portion shown in FIG. 7.
Figure 12:
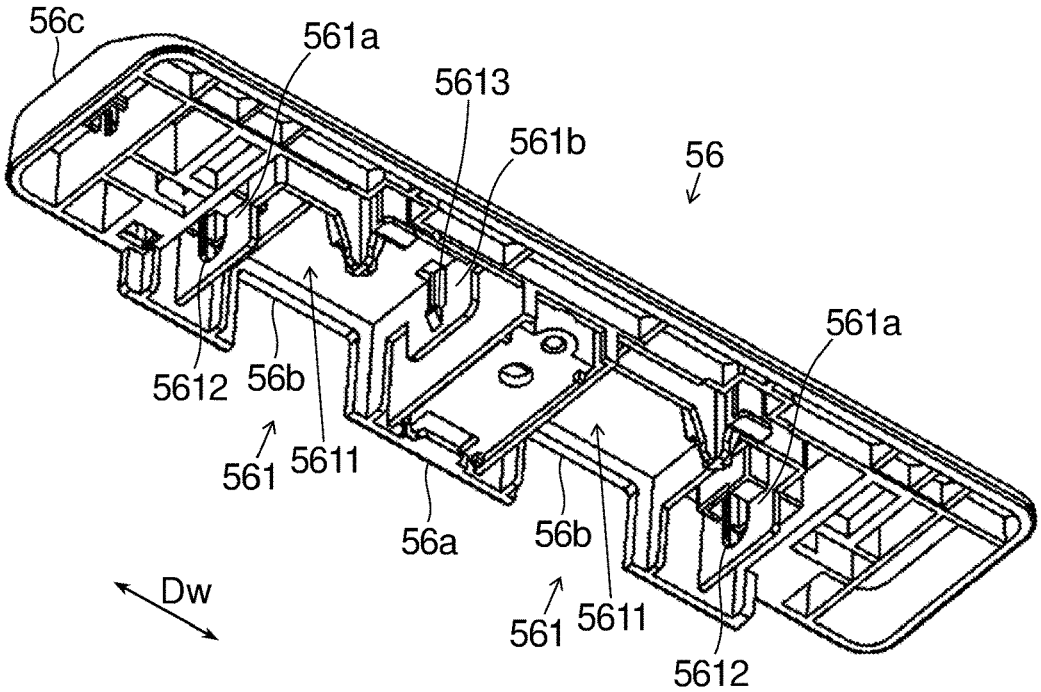
FIG. 12 is a perspective view, as seen from below, of the holding member of the second sheet discharge portion shown in FIG. 7.
Figure 13:
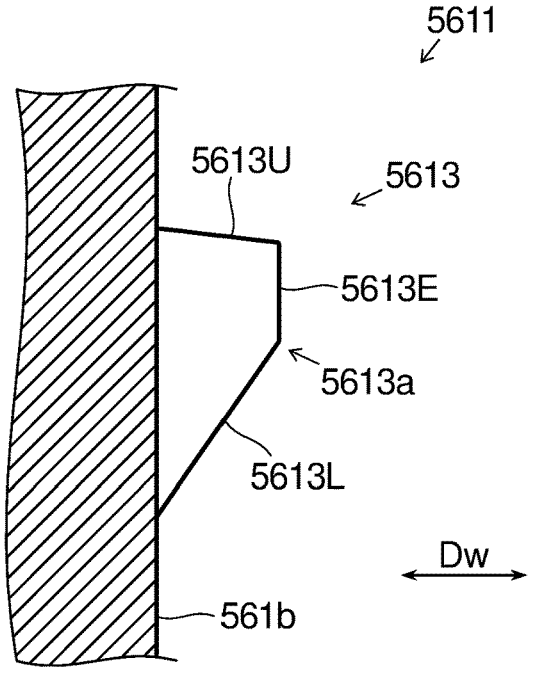
FIG. 13 is a side view of a first protruding portion of the holding member shown in FIG. 12, as seen from a sheet discharge direction.

FIG. 11 is a top view and FIG. 12 is a perspective view as seen from below, of the holding member 56 of the second sheet discharge portion 5 shown in FIG. 7. FIG. 13 is a side view of a first protruding portion 5613*a* of the holding member 56 shown in FIG. 12, as seen from the sheet discharge direction. As mentioned previously, the holding member 56 has the first holding portion 561 and the second holding portion 562.

The first holding portion 561 is formed inside the holding member 56. The first holding portion 561 includes a pair of first holding portions 561 disposed one on each of opposite outer sides of a central part of the holding member 56 in the sheet width direction Dw orthogonal to the sheet discharge direction. The first holding portion 561 has a fitting recessed portion 5611, a first bearing portion 5612, and a locking portion 5613.

The fitting recessed portion 5611 is a portion recessed upward from a lower side of the holding member 56. On a downstream side of the fitting recessed portion 5611 in the sheet discharge direction, an opening portion 56*b* is disposed. The fitting recessed portion 5611 has a space to accommodate an upstream part of the first sheet pressing member 54 in the sheet discharge direction. In other words, the fitting recessed portion 5611 has a space that allows swinging of a later-described locking piece 542 of the first sheet pressing member 54.

The first bearing portion 5612 is formed in a plate-shaped wall portion 561*a* of the fitting recessed portion 5611, the plate-shaped wall portion 561*a* extending in an up-down direction and the sheet discharge direction. The first bearing portion 5612 is constituted as a hole portion that penetrates the plate-shaped wall portion 561*a*. The first bearing portion 5612 is formed at each of two positions aligned in the sheet width direction Dw corresponding to two swing shafts 54*a* (see FIG. 14) of the first sheet pressing member 54. The first bearing portion 5612 has inserted therein the swing shaft 54*a* of the first sheet pressing member 54. The first sheet pressing member 54 is swingably connected to the first holding portion 561 via the swing shaft 54*a*. In other words, the first bearing portion 5612 swingably supports the swing shaft 54*a* of the first sheet pressing member 54.

The locking portion 5613 is provided in the fitting recessed portion 5611. The locking portion 5613 contacts the later-described locking piece 542 of the first sheet pressing member 54 so as to restrict swinging of the first sheet pressing member 54 to a predetermined position. The locking portion 5613 has the first protruding portion 5613*a*.

The first protruding portion 5613*a* is formed on a side surface 561*b* of the plate-shaped wall portion 561*a* of the fitting recessed portion 5611, the plate-shaped wall portion 561*a* extending in the up-down direction and the sheet discharge direction. The first protruding portion 5613*a* is disposed closer to the center than the first bearing portion 5612 with respect to the sheet width direction Dw, and protrudes outward in the sheet width direction Dw so as to face the first bearing portion 5612. That is, the first protruding portion 5613*a* protrudes from the side surface 561*b* of the fitting recessed portion 5611. In other words, the first protruding portion 5613*a* protrudes toward a direction in which the first sheet pressing member 54 attached via the first bearing portion 5612 is located. Further, to be more specific, the first protruding portion 5613*a* protrudes, toward the first sheet pressing member 54, so as to intersect a swing trajectory of the first sheet pressing member 54.

Figure 14:
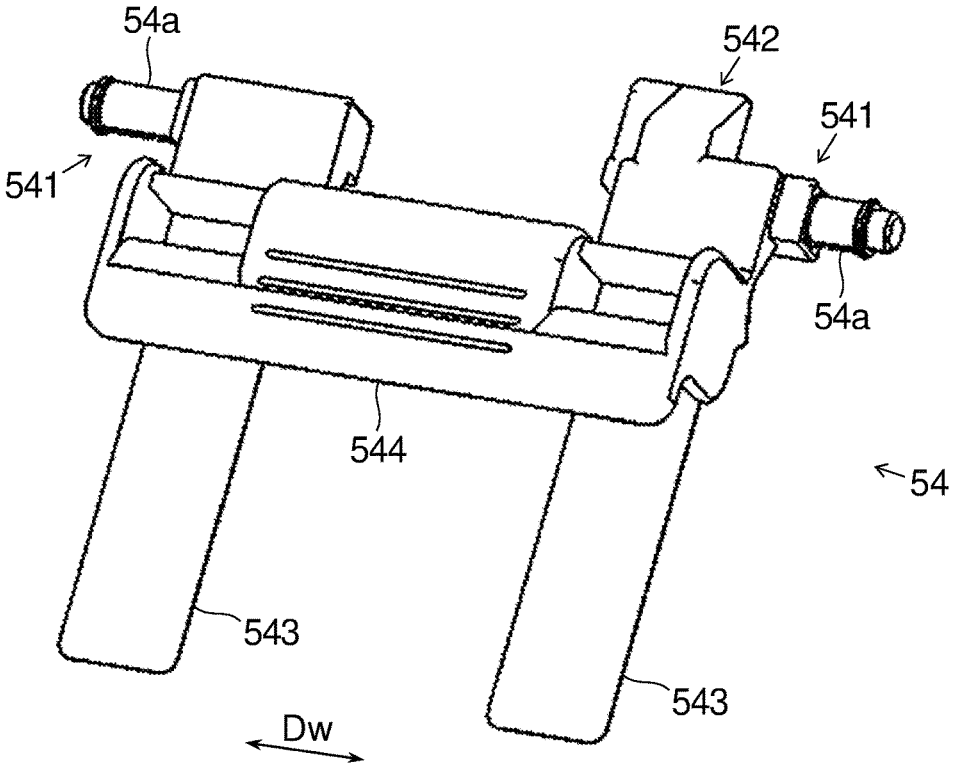
FIG. 14 is a perspective view of the first sheet pressing member of the second sheet discharge portion shown in FIG. 7.

FIG. 14 is a perspective view of the first sheet pressing member 54 of the second sheet discharge portion 5 shown in FIG. 7. The first sheet pressing member 54 has a connection portion 541, the locking piece 542, a pressing portion 543, and a handle portion 544.

The connection portion 541 is disposed on a side of the one end part (the base end part) of the first sheet pressing member 54 in the sheet discharge direction. The connection portion 541 includes two connection portions 541 formed one at each of two positions along the sheet width direction Dw so as to be coupled by the handle portion 544 extending in the sheet width direction Dw. The connection portion 541 and the handle portion 544 are integrally formed of a synthetic resin, for example. At each of opposite end parts of the connection portion 541 in the sheet width direction Dw, the swing shaft 54*a* is disposed so as to extend outward in the sheet width direction Dw. A downstream part of the connection portion 541 in the sheet discharge direction protrudes through the opening portion 56*b* provided in the side surface 56*a* of the holding member 56 toward an outside of the holding member 56 (see FIG. 8).

The locking piece 542 extends from the swing shaft 54*a* toward one side in a direction that is parallel to the sheet discharge direction. In other words, the locking piece 542 is provided on a side that is opposite, with respect to the swing shaft 54*a*, to the side on which the pressing portion 543 is provided. The locking piece 542 engages with the locking portion 5613 of the first holding portion 561 when the first sheet pressing member 54 is positioned at the first pressing position and the first retreat position. As to a detailed configuration of the locking piece 542, a description will be given later with reference to FIG. 15, FIG. 16, and FIG. 17.

The pressing portion 543 is disposed on a side of the other end part (the leading end part) of the first sheet pressing member 54 in the sheet discharge direction. In other words, the pressing portion 543 extends from the swing shaft 54*a* toward the other side in the direction that is parallel to the sheet discharge direction. The pressing portion 543 includes two pressing portions 543 fixed one to each of the two connection portions 541, such that the two pressing portions 543 are disposed at two positions along the sheet width direction Dw so as to be parallel to each other. The pressing portion 543 is constituted of a sheet-shaped member, for example, that extends parallel to the sheet discharge direction. The pressing portion 543 contacts a folded sheet discharged through the second discharge port 51, and presses an upstream part of the folded sheet stacked on the second discharge tray 53 in the discharge direction of the folded sheet.

The handle portion 544 is disposed downstream of the connection portion 541 in the sheet discharge direction, and is located outside the holding member 56. The handle portion 544 extends in the sheet width direction Dw, and couples the two connection portions 541 disposed at the two positions along the sheet width direction Dw. The handle portion 544 is integrally formed with the connection portion 541, for example. A user can hold the handle portion 544 by hand to displace the first sheet pressing member 54.

Figure 15:
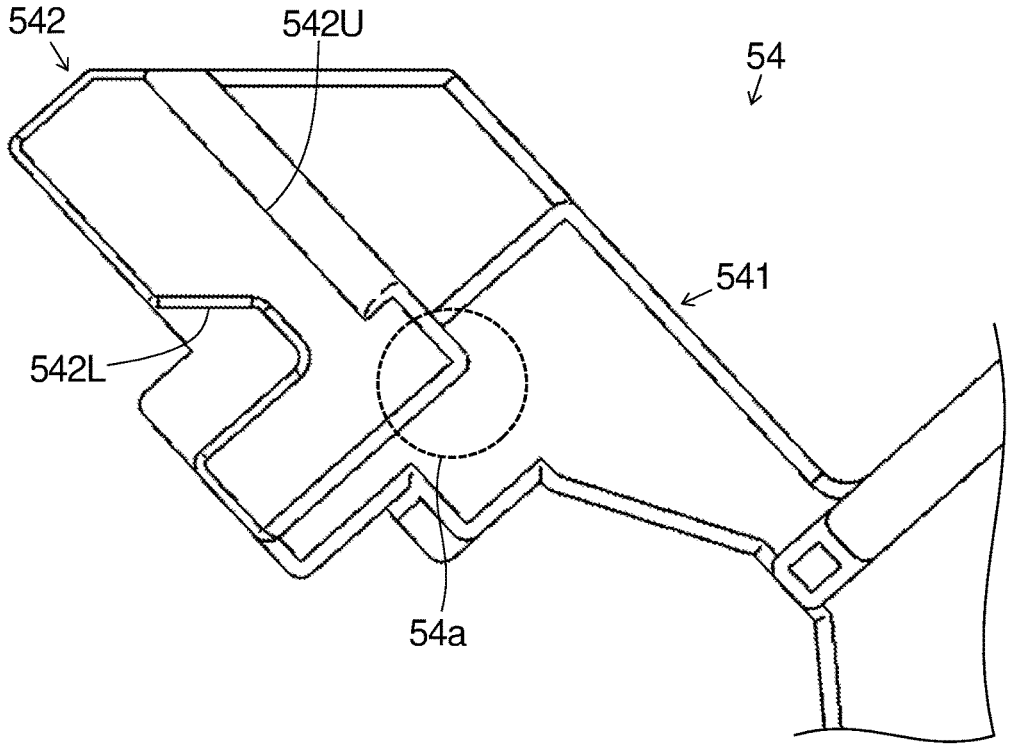
FIG. 15 is a partial rear view of the first sheet pressing member shown in FIG. 14.
Figure 16:
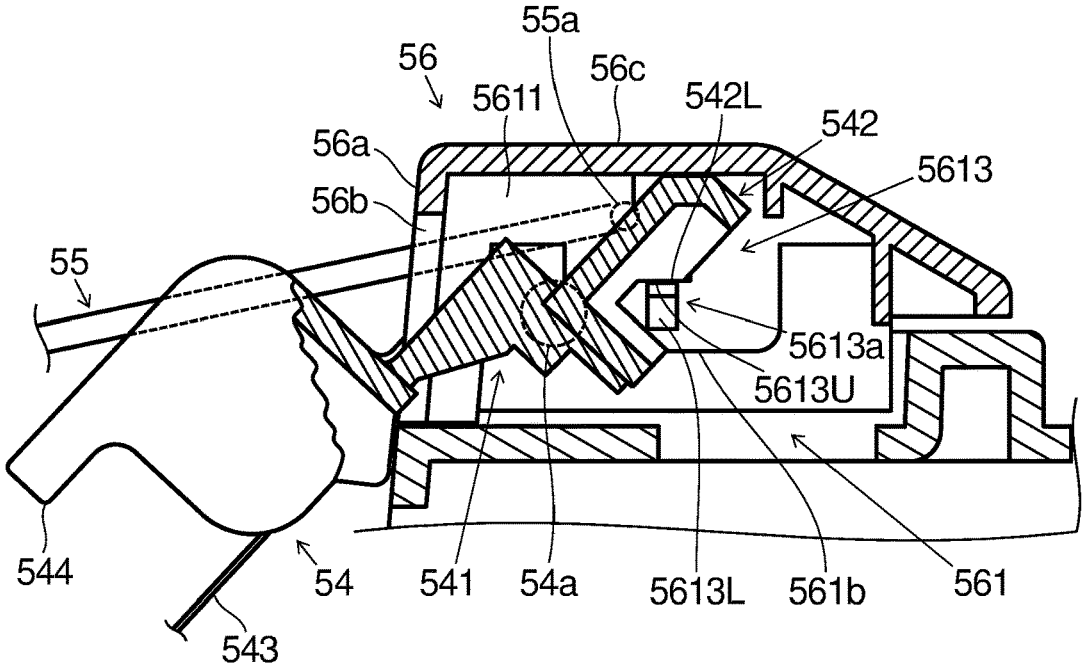
FIG. 16 is a partial sectional front view of the first sheet pressing member (a first pressing position) and the holding member of the second sheet discharge portion shown in FIG. 7.
Figure 17:
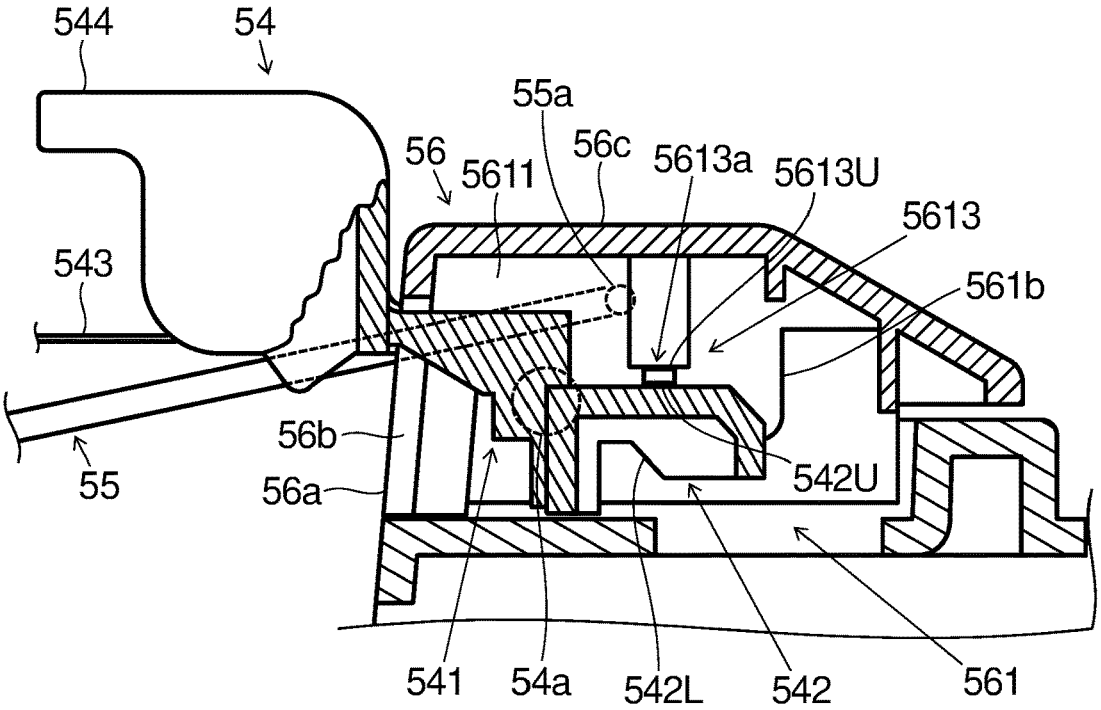
FIG. 17 is a partial sectional front view of the first sheet pressing member (a first retreat position) and the holding member of the second sheet discharge portion shown in FIG. 7.

FIG. 15 is a partial rear view of the first sheet pressing member 54 shown in FIG. 14. FIG. 16 is a partial sectional front view of the first sheet pressing member 54 (the first pressing position) and the holding member 56 of the second sheet discharge portion 5 shown in FIG. 7. FIG. 17 is a partial sectional front view of the first sheet pressing member 54 (the first retreat position) and the holding member 56 of the second sheet discharge portion 5 shown in FIG. 7.

The locking piece 542 is provided on a side opposite to the pressing portion 543 across the swing shaft 54*a* with respect to the sheet discharge direction. The locking piece 542 engages with the first protruding portion 5613*a* of the holding member 56. The locking piece 542 has a lower contact portion 542L and an upper contact portion 542U.

The lower contact portion 542L is, as shown in FIG. 16, constituted of a flat-surface portion that extends substantially horizontally when the first sheet pressing member 54 is in the state (position) of being held at the first pressing position. The lower contact portion 542L contacts the first protruding portion 5613*a* from above. That is, the first protruding portion 5613*a* engages with the locking piece 542 of the first sheet pressing member 54 from one side (a lower side) in the up-down direction to hold the first sheet pressing member 54 at the first pressing position. In other words, the locking portion 5613 locks the locking piece 542 when the first sheet pressing member 54 is positioned at the first pressing position, and holds the first sheet pressing member 54 at the first pressing position.

The upper contact portion 542U is, as shown in FIG. 17, constituted of a flat-surface portion that extends substantially horizontally when the first sheet pressing member 54 in the state (position) of being held at the first retreat position. The upper contact portion 542U contacts the first protruding portion 5613*a* from below. That is, the first protruding portion 5613*a* engages with the locking piece 542 of the first sheet pressing member 54 from the other side (an upper side) in the up-down direction to hold the first sheet pressing member 54 at the first retreat position. In other words, the locking portion 5613 locks the locking piece 542 when the first sheet pressing member 54 is positioned at the first retreat position, and holds the first sheet pressing member 54 at the first retreat position.

According to the above configuration, by using the single first protruding portion 5613*a*, it is possible to hold the first sheet pressing member 54 at the two positions, namely, the first pressing position and the first retreat position. That is, it is possible to form the first sheet pressing member 54 and the holding member 56 with a simple configuration. This makes it possible, with a simple configuration, to stack a large number of sheets on the second discharge tray 53 in an orderly manner.

To be more specific, when the first sheet pressing member 54 is in the state (position) of being held at the first pressing position as shown in FIG. 16, the first sheet pressing member 54 has an upstream end part thereof in the sheet discharge direction in contact with an upper surface 56*c* of the holding member 56 (the fitting recessed portion 5611). As a result, the first sheet pressing member 54 is prevented from rotating counterclockwise in FIG. 16. The locking portion 5613 contacts the locking piece 542 to restrict swinging of the first sheet pressing member 54 to a predetermined position.

That is, as shown in FIG. 16, the first protruding portion 5613*a* contacts the locking piece 542 from below such that the locking piece 542 is sandwiched between an upper end of the first protruding portion 5613*a* and the upper surface 56*c* of the fitting recessed portion 5611, and thereby holds the first sheet pressing member 54 at the first pressing position. Further, as shown in FIG. 17, the locking piece 542 engages with a lower end of the first protruding portion 5613*a*, and thereby holds the first sheet pressing member 54 at the first retreat position.

According to the above configuration, it is possible to suppress unnecessarily close approach of the first sheet pressing member 54 to the second discharge port 51 when the first sheet pressing member 54 is positioned at the first pressing position. Thus, it is possible to prevent obstruction to the conveyance of a sheet to be discharged onto the second discharge tray 53 through the second discharge port 51. That is, it becomes possible to stack sheets on the second discharge tray 53 in an orderly manner.

Furthermore, as described above, the locking piece 542 is provided on the opposite side of the pressing portion 543 with respect to the sheet discharge direction across the swing shaft 54*a*. That is, by using a vacant area (space) upstream of the swing shaft 54*a* with respect to the sheet discharge direction, it is possible to provide a point of engagement of the first sheet pressing member 54 with the holding member 56.

Further, referring back to FIG. 13, the first protruding portion 5613*a* has a leading end surface 5613E, an upper inclined surface 5613U, and a lower inclined surface 5613L. The upper inclined surface 5613U and the lower inclined surface 5613L are formed at parts at which the first protruding portion 5613*a* contacts the locking piece 542.

The leading end surface 5613E is formed at a leading end part of the first protruding portion 5613*a* protruding from the side surface 561*b* of the fitting recessed portion 5611. The leading end surface 5613E extends along the side surface 561*b* in the up-down direction and the sheet discharge direction. In other words, the leading end surface 5613E extends substantially parallel to the side surface 561*b*.

The upper inclined surface 5613U is formed at an upper part of the first protruding portion 5613*a*. The upper inclined surface 5613U has an inclination such that the upper inclined surface 5613U protrudes toward the first sheet pressing member 54 downward. In other words, the upper inclined surface 5613U is inclined downward from an upper side of the first protruding portion 5613*a* toward the leading end surface 5613E into contact with the leading end surface 5613E. When the first sheet pressing member 54 is displaced from the first retreat position to the first pressing position, the upper inclined surface 5613U contacts the lower contact portion 542L of the locking piece 542 from below. The upper inclined surface 5613U guides movement of the locking piece 542.

The lower inclined surface 5613L is formed at a lower part of the first protruding portion 5613*a*. The lower inclined surface 5613L has an inclination such that the lower inclined surface 5613U protrudes toward the first sheet pressing member 54 upward. In other words, the lower inclined surface 5613L is inclined upward from a lower side of the first protruding portion 5613*a* toward the leading end surface 5613E into contact with the leading end surface 5613E. When the first sheet pressing member 54 is displaced from the first pressing position to the first retreat position, the lower inclined surface 5613L contacts the upper contact portion 542U of the locking piece 542 from above. The lower inclined surface 5613L guides movement of the locking piece 542.

With respect to the up-down direction, the lower inclined surface 5613L has a smaller inclination angle than the upper inclined surface 5613U. According to this configuration, it is possible to displace the first sheet pressing member 54 from the first retreat position to the first pressing position with ease. On the other hand, with respect to the up-down direction, the upper inclined surface 5613U is inclined at an angle close to a right angle. According to this configuration, it is possible to suppress unintentional displacement of the first sheet pressing member 54 positioned at the first pressing position toward the first retreat position caused by a sheet discharged toward the second discharge tray 53 contacting the pressing portion 543.

Further, referring back to FIG. 8 and FIG. 11, the second holding portion 562 is formed at an upper part of the holding member 56. The second holding portion 562 includes a pair of second holding portions 562 disposed one on each of opposite outer sides of the first holding portion 561 with respect to the sheet width direction Dw. By disposing the pair of first holding portions 561 one on each side toward the center in the sheet width direction Dw, and disposing the pair of second holding portions 562 one on each of the opposite outer sides of the pair of first holding portions 561 with respect to the sheet width direction Dw, it is possible to suppress contacting of the first sheet pressing member 54 and the second sheet pressing member 55 with each other when they swing.

The second holding portion 562 has a groove portion 5621, a second bearing portion 5622, and a second protruding portion 5623.

The groove portion 5621 includes two groove portions 5621 disposed one at each of two positions located on opposite outer sides of the pair of first holding portions 561 (the first sheet pressing member 54) in the sheet width direction Dw, and extending along the sheet discharge direction. The groove portion 5621 is formed as a recessed portion that is recessed downward. The groove portion 5621 has a groove width (an interval in the sheet width direction Dw) that allows free displacement of the second sheet pressing member 55 when the second sheet pressing member 55, which is constituted of a rod-shaped member, swings.

The second bearing portion 5622 is formed in a plate-shaped wall portion 562*a* inside the groove portion 5621, the plate-shaped wall portion 562*a* extending in the up-down direction and the sheet discharge direction. The second bearing portion 5622 is formed as a hole portion that penetrates through the plate-shaped wall portion 562*a*. The second bearing portion 5622 is formed at each of two positions along the sheet width direction Dw corresponding to two swing shafts 55*a* that the swing shaft 55*a* (see FIG. 19) of the second sheet pressing member 55 includes. The second bearing portion 5622 has the swing shaft 55*a* of the second sheet pressing member 55 inserted therein. That is, the second sheet pressing member 55 is swingably coupled to the second holding portion 562 via the swing shaft 55*a*.

Figure 18:
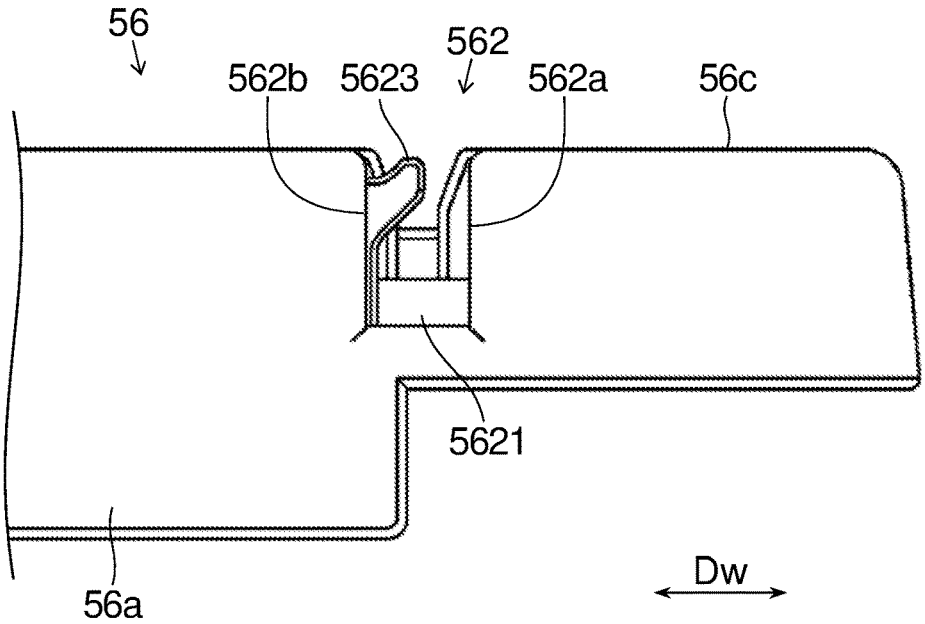
FIG. 18 is a partial side view showing a second holding portion of the holding member of the second sheet discharge portion and its vicinity shown in FIG. 7.

FIG. 18 is a partial side view showing the second holding portion 562 of the holding member 56 of the second sheet discharge portion 5 and its vicinity shown in FIG. 7. The second protruding portion 5623 is disposed in one of the two groove portions 5621. The second protruding portion 5623 is formed in a plate-shaped wall portion 562*b* inside the groove portion 5621, the plate-shaped wall portion 562*b* extending in the up-down direction and the sheet discharge direction. The second protruding portion 5623 is disposed above with respect to a bottom part of the groove portion 5621.

The second protruding portion 5623 protrudes toward an inside of the groove portion 5621. In other words, the second protruding portion 5623 protrudes toward where the second sheet pressing member 55 attached via the second bearing portion 5622 is located. To be more specific, the second protruding portion 5623 protrudes toward the second sheet pressing member 55 so as to intersect a swing trajectory of the second sheet pressing member 55.

Figure 19:
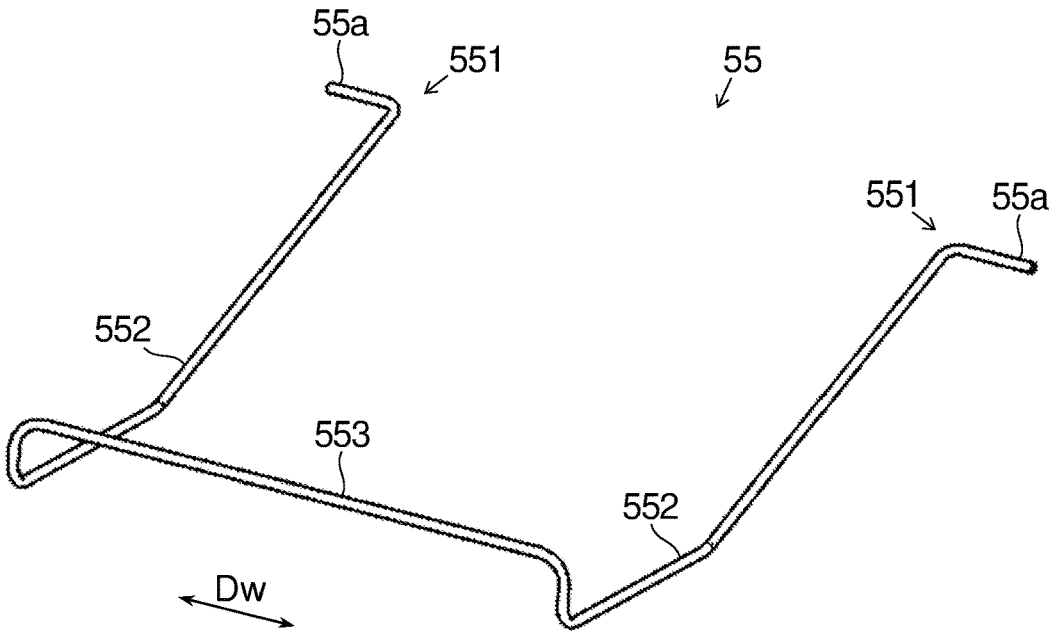
FIG. 19 is a perspective view of the second sheet pressing member of the second sheet discharge portion shown in FIG. 7.

FIG. 19 is a perspective view of the second sheet pressing member 55 of the second sheet discharge portion 5 shown in FIG. 7. In the present embodiment, the second sheet pressing member 55 is constituted of a single rod-shaped member bent at a plurality of predetermined positions. The second sheet pressing member 55 has a connection portion 551, a pressing portion 552, and a handle portion 553.

The connection portion 551 is disposed on a side of one end part (a base end part) of the second sheet pressing member 55 in the sheet discharge direction. The connection portion 551 includes two connection portions 551 formed at opposite end parts of the rod-shaped member, one at each of two positions along the sheet width direction Dw. At each of the connection portion 551, the swing shaft 55*a* is disposed which is bent in the sheet width direction Dw with respect to the sheet discharge direction so as to extend outward in the sheet width direction Dw.

The pressing portion 552 is disposed on a side of the other end part (a leading end part) of the second sheet pressing member 55 in the sheet discharge direction. The pressing portion 552 includes two pressing portions 552 which each extend continuously from a corresponding one of the two connection portions 551 in the sheet discharge direction so as to be disposed parallel to each other at two positions along the sheet width direction Dw. The two pressing portions 552 are disposed one on each of opposite outer sides of the first sheet pressing member 54 with respect to the sheet width direction Dw. The pressing portion 552 has a downstream part thereof bent upward. The two pressing portions 552 are coupled to each other by the handle portion 553 extending in the sheet width direction Dw. The pressing portion 552 contacts a sheet discharged through the second discharge port 51, and presses the downstream part, in the sheet discharge direction, of the sheet stacked on the second discharge tray 53.

The handle portion 553 is disposed at the downstream end of the pressing portion 552 in the sheet discharge direction so as to be located at a central part of the second sheet pressing member 55 in the sheet width direction Dw. The handle portion 553 extends in the sheet width direction Dw, and couples the pressing portions 552 disposed at the two positions along the sheet width direction Dw. The user can hold the handle portion 553 by hand to displace the second sheet pressing member 55.

The groove portion 5621, which extends along the sheet discharge direction, has the second sheet pressing member 55 placed thereon toward a downstream side of the groove portion 5621 in the sheet discharge direction, and thereby holds the second sheet pressing member 55 at the second pressing position (see FIG. 9). The second protruding portion 5623, which is disposed above with respect to the bottom part of the groove portion 5621, has the second sheet pressing member 55 placed thereon so as to be hooked on an upper side thereof, and thereby holds the second sheet pressing member 55 at the second retreat position (see FIG. 10).

According to the above configuration, by using the groove portion 5621 and the second protruding portion 5623, it is possible to hold the second sheet pressing member 55 at the two positions, namely, the second pressing position and the second retreat position. That is, it is possible to form the second sheet pressing member 55 and the holding member 56 with a simple configuration. This makes it possible, with a simple configuration, to stack a large number of sheets on the second discharge tray 53 in an orderly manner.

Further, the second bearing portion 5622 is disposed at a middle part of the groove portion 5621 with respect to the sheet discharge direction (see FIG. 8 and FIG. 11). In other words, the groove portion 5621 extends substantially in a straight line toward both downstream and upstream sides of the second bearing portion 5622 with respect to the sheet discharge direction.

Figure 20:
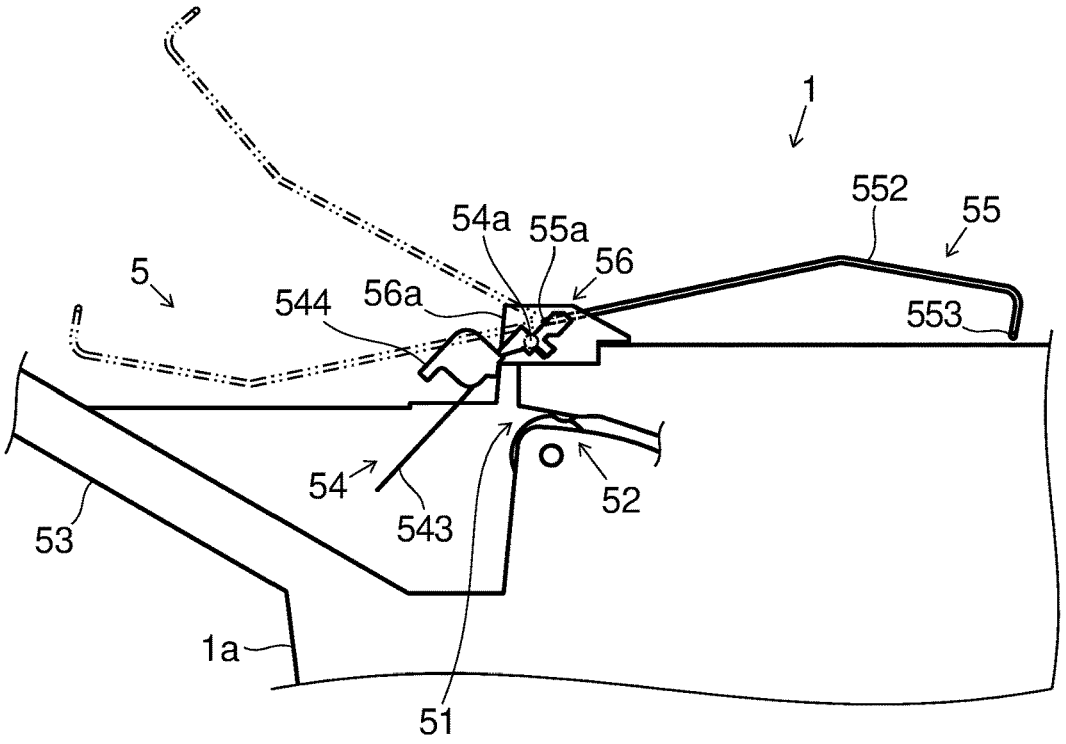
FIG. 20 is a partial sectional front view showing the second discharge portion and its vicinity shown in FIG. 7, with the second sheet pressing member positioned at a third retreat position.

FIG. 20 is a partial sectional front view showing the second discharge portion 5 and its vicinity shown in FIG. 7, with the second sheet pressing member 55 positioned at a third retreat position. As shown in FIG. 20, the second sheet pressing member 55 can be positioned at the third retreat position which is displaced, with respect to the second pressing position, to an opposite side centered about the swing shaft 55*a*. In other words, the second sheet pressing member 55 can be disposed on the upper surface of the sheet post-processing device 1. That is, it is possible to retreat the second sheet pressing member 55 from above the second sheet discharge portion 5 to another position.

The above-described embodiment is by no means meant to limit the scope of the present disclosure, and various modifications can be made and implemented within the scope not departing from the gist of the present disclosure.

What is claimed is:

1. A sheet post-processing device, comprising:

a discharge port having a pair of discharge rollers that discharges a sheet;

a discharge tray on which the sheet discharged through the discharge port is stacked;

a first sheet pressing member that is attached above the pair of discharge rollers and presses an upstream part, in a sheet discharge direction, of the sheet stacked on the discharge tray;

a second sheet pressing member that is attached above the pair of discharge rollers and presses a downstream part, in the sheet discharge direction, of the sheet stacked on the tray; and a holding member that holds the first sheet pressing member and the second sheet pressing member, wherein the holding member has a first holding portion that holds the first sheet pressing member such that the first sheet pressing member is swingable to a first pressing position, at which the first sheet pressing member extends, intersecting a discharge route of the sheet, downward from above the pair of discharge rollers toward the discharge tray to press the sheet, and to a first retreat position retreated to above the discharge route of the sheet, and a second holding portion that holds the second sheet pressing member such that the second sheet pressing member is swingable to a second pressing position, at which the second sheet pressing member extends, intersecting the discharge route of the sheet, downward from above the pair of discharge rollers toward the discharge tray to press the sheet, and to a second retreat position retreated to above the discharge route of the sheet, the first holding portion selectively holds the first sheet pressing member at the first pressing position and the first retreat position, and the second holding portion selectively holds the second sheet pressing member at the second pressing position and the second retreat position.

2. The sheet post-processing device according to claim 1, wherein the first sheet pressing member has a swing shaft, a locking piece extending from the swing shaft toward one side, and a pressing portion extending from the swing shaft toward an other side, the first holding portion has a fitting recessed portion that allows swinging of the locking piece, a bearing portion that swingably supports the swing shaft of the first sheet pressing member, and a locking portion that is provided in the fitting recessed portion, and contacts the locking piece so as to restrict swinging of the first sheet pressing member to a predetermined position, and the locking portion locks the locking piece when the first sheet pressing member is positioned at the first pressing portion so as to hold the first sheet pressing member at the first pressing position, and locks the locking piece when the first sheet pressing member is positioned at the first retreat position so as to hold the first sheet pressing member at the first retreat position.

3. The sheet post-processing device according to claim 2, wherein the locking portion has a first protruding portion that protrudes from a side surface of the fitting recessed portion, such that the first sheet pressing member is held at the first pressing position by the locking piece being sandwiched between an upper end of the first protruding portion and an upper surface of the fitting recessed portion, and the first sheet pressing member is held at the first retreat position by the locking piece being engaged with a lower end of the first protruding portion.

4. The sheet post-processing device according to claim 3, wherein the first protruding portion has a leading end surface that extends along the side surface of the fitting recessed portion, an upper inclined surface that is inclined downward from above toward the leading end surface into contact with the leading end surface, and a lower inclined surface that is inclined upward from below toward the leading end surface into contact with the leading end surface, and the upper inclined surface and the lower inclined surface guide movement of the locking piece.

5. The sheet post-processing device according to claim 1, wherein the second holding portion has a groove portion that extends along the sheet discharge direction and holds the second sheet pressing member at the second pressing position, and a second protruding portion that is disposed above with respect to a bottom part of the groove portion, protrudes so as to intersect a swing trajectory of the second sheet pressing member, and holds the second sheet pressing member at the second retreat position.

6. The sheet post-processing device according to claim 1, wherein the first sheet pressing member and the second sheet pressing member each have a handle portion.

7. The sheet post-processing device according to claim 1, wherein the first holding portion includes a pair of first holding portions disposed one on each of opposite outer sides of a central part of the holding member in a width direction that is orthogonal to the sheet discharge direction, and the second holding portion includes a pair of second holding portions disposed one on each of opposite outer sides of the first holding portion with respect to the width direction.

* * * * *